US005461461A

United States Patent [19]

Harasawa et al.

[11] Patent Number: 5,461,461

[45] Date of Patent: Oct. 24, 1995

[54] IMAGE TRANSFERRING DEVICE AND MEDIUM SEPARATING DEVICE FOR AN IMAGE FORMING APPARATUS

[75] Inventors: Yuko Harasawa, Hayama; Itaru Matsuda, Yokohama; Satoshi Takano; Hideo Yu, both of Tokyo; Yasunori Kawaishi, Narashino; Hideki Kamiyama, Yokohama; Toshiaki Motohashi; Mitsuru Takahashi, both of Tokyo; Takashi Bisaiji, Yokohama, all of Japan

[73] Assignee: Ricoh Company, Ltd., Tokyo, Japan

[21] Appl. No.: 44,032

[22] Filed: Apr. 8, 1993

Related U.S. Application Data

[63] Continuation-in-part of Ser. No. 6,521, Jan. 21, 1993.

[30] Foreign Application Priority Data

| | | | |
|---|---|---|---|
| Jan. 22, 1992 | [JP] | Japan | 4-009125 |
| Mar. 30, 1992 | [JP] | Japan | 4-074366 |
| Apr. 9, 1992 | [JP] | Japan | 4-088916 |
| Apr. 10, 1992 | [JP] | Japan | 4-090701 |
| Nov. 30, 1992 | [JP] | Japan | 4-320937 |
| Jan. 25, 1993 | [JP] | Japan | 5-010159 |

[51] Int. Cl.[6] ..... G03G 21/00

[52] U.S. Cl. ..... 355/208; 355/274

[58] Field of Search ..... 355/271, 273, 355/274, 275, 208

[56] References Cited

U.S. PATENT DOCUMENTS

| | | | |
|---|---|---|---|
| 3,647,292 | 3/1972 | Weikel, Jr. . | |
| 3,830,589 | 8/1974 | Allen . | |
| 3,832,053 | 8/1974 | Goel et al. . | |
| 4,162,843 | 7/1979 | Inoue et al. . | |
| 4,220,699 | 9/1980 | Ishida et al. . | |
| 4,268,157 | 5/1981 | Ebi et al. . | |
| 4,407,580 | 10/1983 | Hashimoto et al. . | |
| 4,411,977 | 10/1983 | Tarumi et al. . | |
| 4,916,547 | 4/1990 | Katsumata et al. | 358/300 |
| 4,984,024 | 1/1991 | Ohkaji et al. | 355/273 |

(List continued on next page.)

FOREIGN PATENT DOCUMENTS

| | | | |
|---|---|---|---|
| 0368617 | 5/1990 | European Pat. Off. . | |
| 0442527 | 8/1991 | European Pat. Off. . | |
| 3908488 | 9/1989 | Germany . | |
| 4040962 | 6/1991 | Germany | 355/275 |
| 58-111960 | 7/1983 | Japan . | |
| 0065866 | 4/1984 | Japan . | |
| 62-203169 | 9/1987 | Japan . | |
| 0292378 | 11/1989 | Japan | 355/275 |
| 246477 | 2/1990 | Japan . | |
| 2-110586 | 4/1990 | Japan . | |
| 0167579 | 7/1991 | Japan . | |
| 0186876 | 8/1991 | Japan | 355/275 |
| 0231273 | 10/1991 | Japan | 355/275 |
| 0231783 | 10/1991 | Japan | 355/275 |
| 0231274 | 10/1991 | Japan | 355/275 |
| 4-121767 | 4/1992 | Japan . | |

OTHER PUBLICATIONS

Patent Abstracts of Japan, vol. 5, No. 134 (P–077), Aug. 26, 1981, JP–A–56 069 653, Jun. 11, 1981.

Patent Abstracts of Japan, vol. 15, No. 218 (P–1210), Jun. 4, 1991, JP–A–03 062 077, Mar. 18, 1991.

*Primary Examiner*—Robert Beatty

*Attorney, Agent, or Firm*—Oblon, Spivak, McClelland, Maier & Neustadt

[57] ABSTRACT

An image forming apparatus includes a photoconductive element and a transfer belt, with an electrode or bias applicator located downstream from a nip formed between the photoconductive element and the transfer belt. Upstream from the nip, a roller is provided which can also act as an electrode, or which can be held in an electrically floating state. A bias voltage can also be provided to the roller upstream from the nip, with the voltage equal to or less than the voltage applied to the downstream electrode. In addition, the applied voltages can be varied based upon the position of a sheet of paper, or in response to changes in humidity.

32 Claims, 31 Drawing Sheets

U.S. PATENT DOCUMENTS 5,138,363 8/1992 Yuge .
5,140,376 8/1992 Gotoda et al. ..... 355/274
5,148,224 9/1992 Yamada et al. .
5,153,653 10/1992 Fuma et al. ..... 355/275
5,172,173 12/1992 Goto et al. ..... 355/275
5,182,598 1/1993 Hara et al. ..... 355/208
5,189,479 2/1993 Matsuda et al. ..... 355/274
5,198,863 3/1993 Goto et al. ..... 355/274
5,268,725 12/1993 Koga et al. .

VOLTAGE (V)
4
3
2
1
--o-- BELT A
—X— BELT B

IMAGE DENSITY
1.5
1.4
1.3
1.2
1.1
1.0
0.9
10
20
30
40
50
60
$I_1 - I_2$ (μA)

VOLTAGE (V)
4
3
2
1

IMAGE DENSITY
1.5
1.4
1.3
1.2
1.1
1.0
0.9
10
20
30
40
50
60
$I_1 - I_2$ ($\mu$A)
THIN SHEET
THICK SHEET

IMAGE TRANSFERRING DEVICE AND MEDIUM SEPARATING DEVICE FOR AN IMAGE FORMING APPARATUS

BACKGROUND OF THE INVENTION

The present invention is a continuation-in-part of copending U.S. application Ser. No. 08/006,521, filed Jan. 21, 1993.

The present invention relates to an image transferring device for a copier, printer or similar electrophotographic image forming apparatus and, more particularly, to a positional relation between a transfer bias section and a discharge section with respect to a sheet and control over the transfer bias in an image transferring device of the type transferring an image from an image carrier to a transfer belt while transporting the sheet and causing it to electrostatically adhere to the belt. The present invention is also concerned with a separating device capable of surely separating a transfer medium in the form of a sheet with no regard to the environment.

It is a common practice with an image forming apparatus to use an image transferring device of the type electrostatically transferring a toner image formed on an image carrier, or photoconductive element, to a sheet carried on a transfer belt to which an electric field opposite in polarity to the toner image is applied, and a separating device for separating the sheet from the photoconductive element. The devices of the type described usually includes an arrangement for applying a transfer bias to the transfer belt. For example, an electrode member is connected to a high-tension power source and held in contact with the rear of the belt at an image transfer position. Such an arrangement, or so-called contact type transfer and separation arrangement, is advantageous over one which relies on a corona charger since it does not produce harmful ozone and can operate with a low voltage. The transfer belt is sometimes replaced with a transfer roller. The contact type transfer and separation system has been proposed in various forms, as disclosed in Japanese Patent Laid-Open Publication Nos. 123385/1990, 123386/1990, 287380/1990, and 287381/1990 by way of example.

In addition to transferring a toner image from the photoconductive element to the sheet, the devices for transferring an image and separating a sheet described above deposit a polarized charge on the sheet by the transfer bias so as to cause the sheet to electrostatically adhere to the belt. Therefore, as the belt is moved, the sheet can be transported by the belt and separated from the belt due to the electrostatic adhesion.

However, when the sheet is caused to electrostatically adhere to the belt, it has to be separated from the belt after image transfer. For the separation of the sheet, use may be made of a transfer belt having a resistance of $10^{10}$.Ω.cm to $10^{13}$.Ω.cm, and a discharge member located downstream of an image transfer position with respect to an intended direction of movement of the belt for dissipating the charge of the belt, as disclosed in Japanese Patent Laid-Open Publication No. 83762/1988 by way of example. The discharge member reduces or cancels the charge of the sheet to promote easy separation of the sheet. Regarding the discharge of the belt, Japanese Patent Laid-Open Publication No. 96838/1978, for example, teaches an arrangement which uses a transfer belt having a resistance of $10^{8}$ Ω.cm to $10^{13}$ Ω.cm and, in the event of continuously transferring images from a plurality of photoconductive elements to a sheet carried on the belt, dissipates a charge of the belt deposited by a discharge ascribable to the separation of the sheet from one photoconductive element before the belt faces the next element.

On the other hand, when the transfer bias is maintained constant, a current to flow to the photoconductive element changes relative to the bias set at the transfer belt side due to changes in temperature, humidity and other environmental conditions. For example, in a high temperature and high humidity environment, an excessive current is apt to flow to the photoconductive element since the belt and sheet absorb moisture to lower their resistances. This increases the charge deposited on the photoconductive element and often causes the sheet to wrap around the element. In the opposite environment, the transfer of a toner image becomes defective. In the light of this, use may be made of control circuitry having a controller for controlling the output current of a high-tension power source and to which a roller which supports the belt is connected, as taught in, for example, Japanese Patent Laid-Open Publication No. 231274/1991. The control circuitry detects the output current of the power source by the support roller via the belt and controls the output current in matching relation to a feedback current flowing through the support roller. With such control circuitry, it is possible to maintain the current to flow to the drum constant and thereby prevent the sheet from wrapping around the drum while eliminating defective image transfer.

However, simply selecting an electric characteristic with regard to the belt is not satisfactory when the transfer bias or the discharging operation is to be set as stated above. Particularly, it is necessary to eliminate the wrapping of the sheet, defective image transfer and incomplete sheet separation by adequately positioning the constituents of the image transfer device relative to each other and selecting adequate materials at the actual design stage. Moreover, for the control of the surface potential of the sheet via the belt, not only changes in environment but also other factors, e.g., changes in surface potential ascribable to changes in resistance which are in turn ascribable to irregularities in the quality of belts particular to the production line and the size of an image have to be taken into account. Should such changes be neglected, the amount of charge for setting up an electric field required for image transfer would change. This would not only degrade the quality of an image but also aggravate the defective sheet separation.

On the other hand, there is available a copier or similar electrophotographic image forming apparatus of the type including a carrier for carrying a toner image transferred thereto at a transfer position and transporting it while being rotated. In this type of apparatus, a toner image formed on a photoconductive element is transferred to a belt at a first transfer position. As the belt is rotated to transport the toner image to a second transfer position, the toner image is transferred from the belt to a sheet. At a position upstream of the first transfer position, a transfer potential is applied to the belt to transfer the toner image from the photoconductive element to the belt.

The contact type image transfer and sheet separation system is advantageous over the corona type system in that it reduces ozone and requires only a low power source voltage, as discussed above. However, the problem with the transfer belt is that the adequate bias voltage to be applied from the power source to the belt changes due to various causes including irregularities in the resistance of the belt, varying ambient conditions, kind of sheets, and area of a toner image. This prevents the toner image from being surely transferred from the belt to the sheet. Specifically, the amount of charge deposited on the belt by the bias potential from the power source deviates from one required to effect desirable image transfer due to irregularities in the resistance of the belt ascribable to the production line, changes in the resistance ascribable to the varying ambient conditions, changes in the material and thickness of sheets, etc. More specifically, when the amount of charge required to effect desirable image transfer is deposited on a transfer belt, discharge does not occur in a pretransfer region upstream of the nip portion between the photoconductive element and the belt. In this condition, a toner charged to positive polarity, for example, is transferred to the sheet carried on the belt in a transfer region. In this case, a bias potential is applied from a power source to the belt. When the actual amount of charge on the belt is deviated from the expected one due to the above-stated reasons, discharge occurs in the pretransfer region. This causes a negative charge to deposit on the toner and thereby charges the front and the rear of the belt to positive polarity and negative polarity, respectively. As a result, despite that the bias potential from the power source is adequate, the toner is prevented from being transferred from the photoconductive element to the sheet, resulting in the local omission of an image on the sheet.

Further, the transfer belt not only transfers the toner image from the photoconductive element to a sheet or similar transfer medium, but also separates the sheet from the element by electrostatically retaining it thereon. However, the problem is that the separation of the sheet from the photoconductive element depends on the ambient conditions. Particularly, when the water content of the sheet increases in a hot and humid environment, it is likely that the sheet is adhered to the photoconductive element and not to the belt and cannot be separated from the element. Should the sheet be forcibly separated from the photoconductive element by a pawl or similar implementation, it would scratched or creased to degrade the image quality.

In the electrophotographic image forming apparatus, a transfer potential is applied to the belt at a position upstream of the first transfer position so as to transfer the toner image from the photoconductive element to the belt. This brings about a problem that the toner flies toward the belt at a position upstream of the first transfer position, thickening lines, blurring characters, reducing sharpness or otherwise degrading images.

SUMMARY OF THE INVENTION

It is, therefore, an object of the present invention to provide an image transferring device for an image forming apparatus which surely prevents a sheet from wrapping around a photoconductive element and from being incompletely separated from a transfer belt.

It is another object of the present invention to provide a separating device for an image forming apparatus which surely transfers an image to produce an attractive image and, in addition, insures desirable separation of a transfer medium from a photoconductive element with no regard to the environment.

In accordance with the present invention, an image forming apparatus comprises a photoconductive element for forming a toner image thereon, a transfer medium movable in contact with the photoconductive element over a predetermined nip width to allow the toner image to be transferred from the photoconductive element to the transfer medium, a transfer bias applying device for applying a predetermined transfer bias to the transfer medium, and a potential gradient generating device for providing the transfer bias with a potential gradient such that an amount of transfer of the toner image from the photoconductive element to the transfer medium increases in a region upstream of a transfer region with respect to the photoconductive element and terminating at a point where the photoconductive element and transfer medium begin to contact each other.

Also, in accordance with the present invention, an image forming apparatus comprises a photoconductive element for forming a toner image thereon, a transfer belt movable in contact with the photoconductive element over a predetermined nip width for transporting a sheet to allow the toner image to be transferred from the photoconductive element to the sheet, a transfer potential bias applying device for applying a predetermined transfer bias to the transfer belt, a potential gradient generating device for providing the transfer bias with a potential gradient such that an amount of transfer of the toner image from the photoconductive element to the sheet increases in a region upstream of a nip portion with respect to the photoconductive element and terminating at a point where the photoconductive element and transfer belt begin to contact each other, and a bias applying device for applying a bias to the potential gradient generating device after the sheet has moved a predetermined distance away from the nip portion.

Further, in accordance with the present invention, an image forming apparatus comprises a photoconductive element for forming a toner image thereon, a transfer belt movable in contact with the photoconductive element over a predetermined nip width for transporting a sheet to allow the toner image to be transferred from the photoconductive element to the sheet, a transfer bias applying device contacting the transfer belt at a position downstream of the photoconductive element for applying a predetermined bias to the transfer belt, and a potential gradient generating device having a dielectric layer on a surface thereof and contacting the transfer belt at a position upstream of the photoconductive element for providing the transfer bias with a potential gradient such that an amount of transfer of the toner image from the photoconductive element to the sheet increases in a region upstream of the nip portion with respect to the photoconductive element and terminating at a point where the photoconductive element and transfer belt contact each other.

Moreover, in accordance with the present invention, an image forming apparatus comprises a photoconductive element for forming a toner image thereon, a transfer belt movable in contact with the photoconductive element over a predetermined nip width for transporting a sheet to allow the toner image to be transferred from the photoconductive element to the sheet, a transfer bias applying device contacting said transfer belt at a position downstream of the photoconductive element for applying a predetermined bias to the transfer belt, and a potential gradient generating device having an elastic dielectric layer on a surface thereof and contacting a rear of the transfer belt in a position upstream of the photoconductive element for providing the transfer bias with a potential gradient such that an amount of transfer of the toner image from the photoconductive element to the sheet increases in a region upstream of the nip portion with respect to said transfer belt and terminating at a point where the photoconductive element and transfer belt contact each other.

In addition, in accordance with the present invention, an image forming apparatus comprises a photoconductive element for forming a toner image thereon, a transfer medium contacting the photoconductive element over a predetermined nip width in a transfer region and undergoing a step of transferring the toner image formed on the photoconductive element a plurality of times, a first electrode contacting the transfer medium at a position downstream of the transfer region, a second electrode contacting the transfer medium at a position upstream of the transfer region, and a potential gradient generating device for providing the transfer bias with a potential gradient by applying a transfer bias to the first electrode or both of the first and said second electrodes, and applying, when a toner is absent on the transfer medium, a bias of the same polarity as the toner to the second electrode or applying, when the toner is present on the transfer medium, a bias of opposite polarity to the toner to the second electrode, such that an amount of transfer of the toner image from the photoconductive element to the transfer medium increases in a region upstream of a transfer region with respect to the photoconductive element and terminating at a point where the photoconductive element and transfer medium contact each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
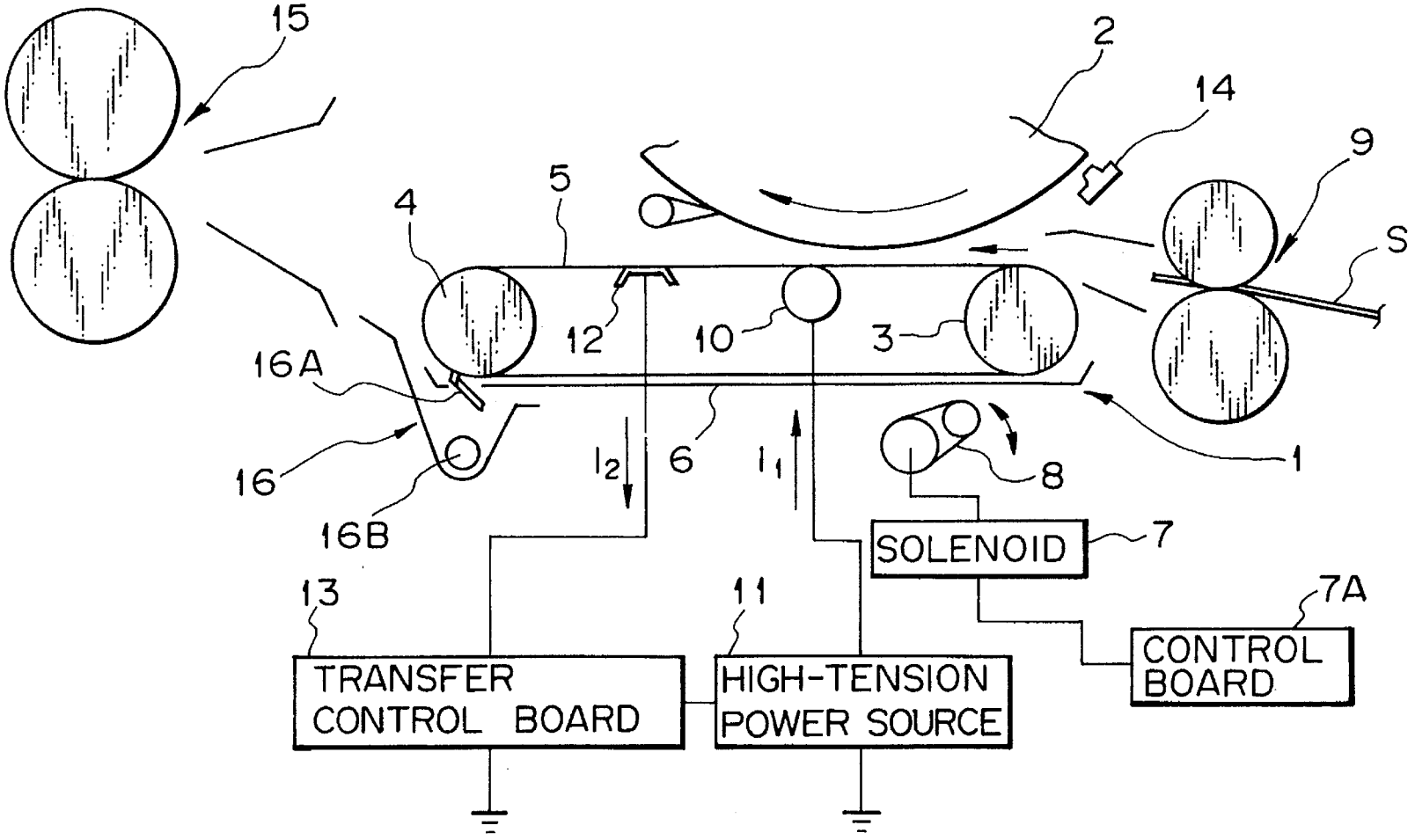
FIG. 1 is a section showing the general construction of an image transferring device embodying the present invention.
Figure 3:
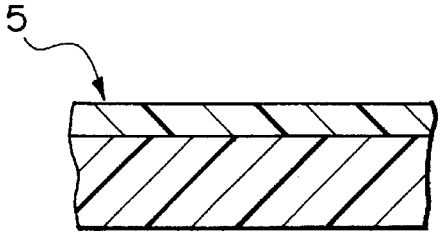
FIG. 3 is a section of a transfer belt included in the embodiment.

Referring to FIG. 1 of the drawings, an image transferring device for image forming apparatus embodying the present invention is shown and generally designated by the reference numeral 1. As shown, the device 1 has a transfer belt 5 passed over a pair of rollers 3 and 4. An image is formed on a photoconductive drum 2 and transferred to a sheet S carried on the belt 5. Specifically, as the roller, or drive roller, 4 is rotated, the belt 5 is moved in a direction for transferring the sheet S (indicated by an arrow in the figure) at a position where it faces the drum 2. As shown in FIG. 3, the belt 5 has a double layer structure, i.e., an outer or surface layer and an inner layer. The surface layer has an electric resistance of $1\times10^9$ Ω to $1\times10^{12}$ Ω as measured at the surface of the belt 5. The inner layer has a surface resistivity of $8\times10^6$ Ω to $8\times10^8$ Ω and a volume resistivity of $5\times10^8$.Ω.cm to $5\times10^{10}$Ω.cm.

The rollers 3 and 4 are rotatably supported by a support 6. The support 6 is angularly movable about a position where it supports the drive roller 4 which is located downstream of a transfer position with respect to the direction of sheet feed. A solenoid 7 is operated by a control board 7A to actuate the side of the support 6 adjoining the transfer position side of the belt 5. Specifically, a lever 8 is connected to the solenoid 7 to move the support 6 into and out of contact with the drum 2. Sheet transporting means in the form of a register roller 9 drives the sheet S toward the drum 2 in synchronism with an image formed on the drum 2. As the leading edge of the sheet S approaches the drum 2, the support 6 is moved toward the drum 2. As a result, the belt 5 is brought into contact with the drum 2 to form a nip portion B, FIG. 2, where it can transport the sheet S while urging the sheet S against the drum 2.

In the illustrative embodiment, the roller 3 closer to the drum 2 than the roller 4 is implemented as a driven roller made of metal or similar conductive material having a relatively great electric capacity. The conductive driven roller 3 is held in a floating state to eliminate discharge ascribable to charge-up. In this configuration, charges deposited on the roller 3 are dissipated via the belt 5 having the above-stated electric characteristic. The surface of the roller 3 is tapered in the axial direction to prevent the belt 5 from becoming offset. The drive roller 4 is made of an insulating material in order to eliminate a sharp migration of charge which would cause a discharge to occur in the event of separation of the sheet S from the belt 5, as will be described specifically later. For example, the roller 4 is made of insulating EP rubber or chloroprene rubber for the above purpose and, at the same time, for enhancing the gripping force which the roller 4 exerts on the belt 5.

A bias roller 10 is located downstream of the driven roller 4 with respect to the moving direction of the belt 5 and held in contact with the inner surface of the belt 5. Connected to a high-tension power source 11, the bias roller 10 constitutes a contact electrode for applying to the belt 5 a charge which is opposite in polarity to a toner deposited on the drum 2. A contact plate 12 is positioned downstream of the bias roller 10 and in such a manner as to face the sheet S with the intermediary of one of opposite runs of the belt 5 corresponding to the sheet transport surface of the belt 5. The contact plate 12 detects a current flowing through the belt 5 as a feedback current. The current to be fed from the bias roller 10 is controlled in response to the output of the contact plate 12. A transfer control board 13 is connected to the contact plate 12 to set a current to be applied to the bias roller 10 on the basis of the detected current. The transfer control board 13 is also connected to the high-tension power source 11.

Figure 2:
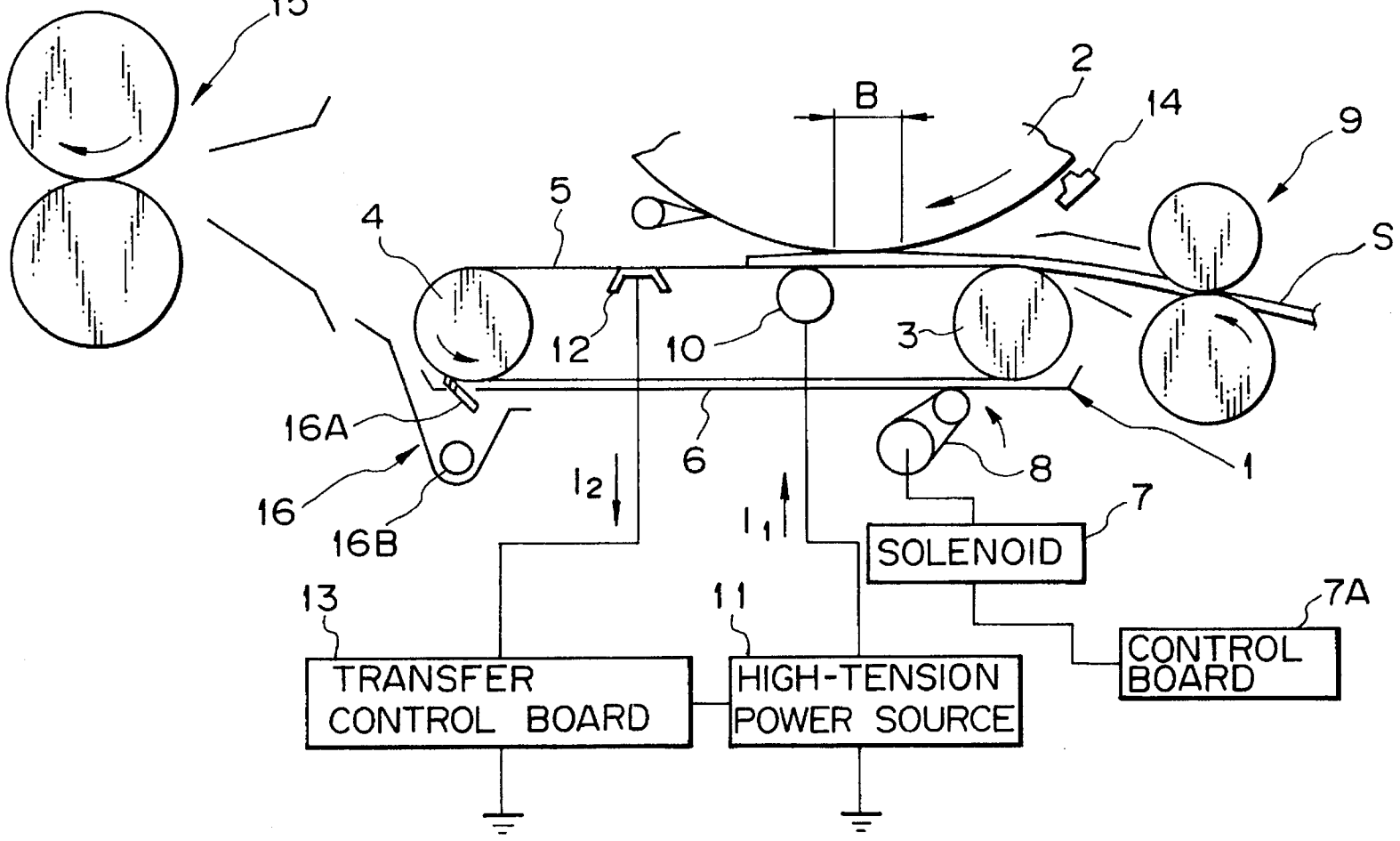
FIG. 2 demonstrates the operation of the embodiment for transferring an image.
Figure 4:
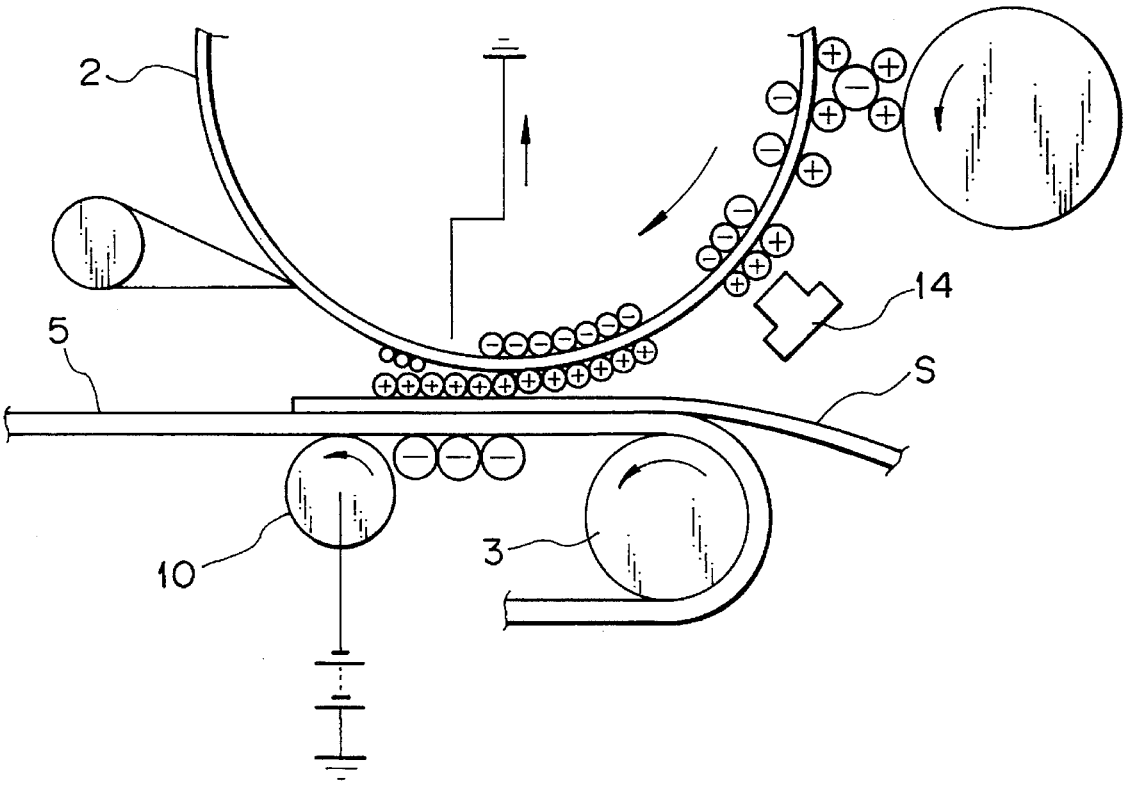
FIG. 4 is representative of a toner deposited on a photoconductive element included in the embodiment together with charges deposited on a sheet and the transfer belt for electrostatically transferring the toner.

In operation, as the sheet S is fed from the register roller 9, the support 6 and, therefore, the belt 5 is angularly moved toward the drum 2. Then, the belt 5 forms the nip portion B between it and the drum 2, as shown in FIG. 2. The nip portion B has a dimension of about 4 mm to about 8 mm in the direction of sheet transport. On the other hand, the drum 2 has the surface thereof charged to, for example, −800 V and electrostatically carries a toner thereon, as shown in FIG. 4. Before such a surface of the drum 2 reaches the nip portion B, the surface potential is lowered by a pretransfer discharge lamp 14. In FIG. 4, the size of a charge is represented by the diameter of a circle; charges lowered by the lamp 14 are represented by smaller circles. In the nip portion B, the toner on the drum 2 is transferred to the sheet S by the bias from the bias roller 10. In the embodiment, a voltage of −1.5 kV to −2.0 kV is applied to the bias roller 10, so that the potential of the belt 5 may range from −1.3 kV to −1.8 kV as measured in the nip portion B.

The above-mentioned potential of the belt 5 in the nip portion B is selected for the following reason. In FIGS. 1 and 2, assume that the output current of the power source 11 is $I_1$, and that the feedback current flown from the contact plate 12 to ground via the belt 5 is $I_2$. Then, the current $I_1$ is controlled to satisfy an equation:

$$I_1 - I_2 = I_{OUT} \quad \text{Eq. (1)}$$

where $I_{OUT}$ is constant. This is successful in stabilizing the surface potential $V_P$ of the sheet S and, therefore, in eliminating changes in transfer efficiency with no regard to temperature, humidity and other ambient conditions and irregularities in the quality of belts 5. More specifically, by considering that a current $I_{OUT}$ flows toward the drum 2 via the belt 5 and sheet S, it is possible to prevent the sheet separability and image transferability from being effected by changes in the easiness of current flow to the drum 2 which are ascribable to a decrease or an an increase in the surface potential $V_P$ of the sheet S.

As stated above, the potential of the belt 5 in the nip portion B is so set as to obtain the surface potential $V_P$ of the sheet S. In this connection, favorable image transfer was achieved when the $I_{OUT}$ was 35 μA plus 5 μA. It is to be noted that regarding the above-stated potential range of "−1.3 kV to −1.8 kV" of the belt 5, the surface potential of the sheet S may sometimes exceed the range, depending on the environment, the kind of sheet and/or the change in the resistance of the belt 5.

When an image is transferred from the drum 2 to the sheet S, the sheet S is also charged. Therefore, the sheet S can be electrostatically attracted onto the belt 5 and thereby separated from the drum 2 on the basis of the relation between the true charge on the belt 5 and the polarized charge on the sheet S. This is enhanced by the size of the transfer bias (higher than −3 kV) relative to the charge potential (−800 V) of the drum 2 and by, apart from the electrostatic relation, the elasticity of the sheet S using the curvature of the drum 2.

However, the electrostatic adhesion relying on a potential described above is not satisfactory since in a high humidity environment a current easily flows to the drum 2 to obstruct the separation of the sheet S. In the light of this, the surface layer of the belt 5, FIG. 2, is provided with a relatively high resistance so as to delay the shift of the true charge from the belt 5 to the sheet S in the nip portion B and, therefore, the flow of a current to the drum 2. In addition, the bias roller 10 is located downstream of the nip portion B in the direction of sheet transport. With this configuration, it is possible to eliminate the electrostatic adhesion of the sheet S and drum 2. To delay the shift of the true charge means to prevent a charge from depositing on the sheet S before the sheet S reaches the nip portion B. Hence, the sheet S is prevented from wrapping around the drum 2 or from being incompletely separated from the drum 2.

Also, the belt 5 should preferably be made of a material whose resistance is sparingly susceptible to changes in environment. For example, when the belt 5 is implemented as an elastic belt made of rubber, chloroprene or similar material having low hygroscopic property and stable resistance is more desirable than, for example, urethane rubber which is highly hygroscopic.

The current $I_{OUT}$ to flow to the drum 2 is not unconditionally selected. For example, the current $I_{OUT}$ may be reduced when the potential of the toner is low as in a digital system. Conversely, when the pretransfer discharge lamp is not used, the current $I_{OUT}$ may be increased in matching relation to an increase in the surface potential of the drum 2.

The sheet S passed the nip portion B is transported by the belt 5. During the transport, the electrostatic adhesion relation between the sheet S and the belt 5 is reduced or cancelled by the discharge effected by the contact plate 12. At this instant, the rate or speed at which the charge deposited on the sheet S is reduced is dependent on the resistance of the sheet S and the electrostatic capacity. Specifically, assuming that the resistance of the sheet is R and the electrostatic capacitance is C, the rate is expressed as:

$$\tau \text{ (time constant)} = C \cdot R \qquad \text{Eq. (2)}$$

Hence, when the sheet S is implemented as an OHP sheet or has the resistance thereof increased due to high humidity, a substantial period of time is necessary for the charge deposited thereon to decrease. Such a sheet S is separated from the belt 5 by the curvature of the drive roller 4. For this purpose, the drive roller 4 is provided with a diameter less than 16 mm. Experiments showed that when use was made of such a drive roller, a high quality 45K sheet (rigidity: horizontal 21 ($cm^3$/100)) could be separated.

After the image transfer from the drum 2 to the sheet S and the separation of the sheet S, the solenoid 7 is deenergized to move the support 6 away from the drum 2. Then, the surface of the belt 5 is cleaned by a cleaning device 16 having a cleaning blade 16A. The cleaning blade 16A rubs the surface of the belt 5 to scrape off the toner transferred from the background of the drum 2 to the belt 5, the toner scattered around the belt 5 without being transferred, and paper dust separated from the sheet S. The belt 5 to be rubbed by the blade 16A is provided with a coefficient of friction low enough to eliminate an increase in required torque due to an increase in frictional resistance and to eliminate the deformation of the blade 16A. Specifically, in the embodiment, the surface of the belt 5 is covered with fluorine (vinylidene polyfluoride). The toner and paper dust removed from the belt 5 by the blade 16A is collected in a waste toner container, not shown, by a coil 16B.

The various members for setting the surface potential of the sheet S as described above are related in position, as follows. To begin with, assuming that the current $I_{OUT}$ is constant, a change in the current $I_1$ to the bias roller 10 causes the output voltage $V_O$ of the power source 11 to change, as indicated by the Eq. (1). Assume that when the output voltage $V_O$ has a maximum value $V_{max}$, the distance from the driven roller 3 to the nip portion B is $L_1$ while the output voltage $V_O$ is applied to the bias roller 10. Then, the distance $L_1$ is so selected as to satisfy a relation:

$$L_1 \geqq a \times |V_O| \qquad \text{Eq. (3)}$$

where a is 1.0 (mm/kV). Further, assuming that the distance from the nip portion B to the bias roller 10 is $L_2$, then the distance $L_2$ is determined to satisfy a relation:

$$L_2 \geqq a \times |VO|$$

$$\text{where a is 1.0 (mm/kV)} \qquad \text{Eq. (4)}$$

Why the distances $L_1$ and $L_2$ are selected as stated above is as follows. Assume that the belt 5 is a dielectric body having the time constant $\tau$. Then, as the bias roller 10 approaches the drum 2, e.g., reaches a position just below the drum 2 while the output voltage $V_O$ is high, dielectric breakdown is apt to occur in a conductor included in the drum 2. The distances $L_1$ and $L_2$ successfully eliminate such an occurrence.

Specifically, assuming that $L_1 = L_2 = 1$ mm and $V_O = -3$ kV, then a leak occurs from the bias roller 10 to the drum 2 over the gap. The leak occurs at, for example, micropores and comparatively thin portions which may exist in the belt 5. The leak breaks the portion where it occurred, i.e., it forms macropores in the surface of the belt 5 and that of the drum 2. As a result, power for forming an electric field for image transfer is not used and, therefore, the electric field is not formed, making the image transfer defective. Moreover, a spark discharge ascribable to the leak is not desirable from the safety standpoint. This is also true with the driven roller 3 held in a floating state.

For the reasons described above, the embodiment selects a $V_{max}$ of −3 kV and distances $L_1$ and $L_2$ of 8 mm and 6 mm, respectively. It is to be noted that the value a is variable in matching relation to the output voltage $V_O$ and may be 2 or greater than 2.

Assuming that the distance from the bias roller 10 to the contact plate 12 is $L_3$, then the distance $L_3$ is related to the distance $L_2$, as follows:

$$L_3 \geqq L_2$$

This is because, to achieve $I_{OUT}$ efficiently, the distance $L_3$, i.e., the resistance of the belt 5 per unit area should be great enough to distribute $I_1$ in a relation of $I_{OUT} > I_2$. Specifically, assuming that the feedback current $I_2$ is zero, i.e., the contact plate 12 is absent, $I_1$ will be equal to $I_{OUT}$, providing 100% efficiency. However, since the entire surface of the belt 5 will have exactly the same potential as the output voltage $V_O$, electric noise will occur at the positions where the rollers contact the belt 5 and effect the control system to bring about errors.

Hence, a relation $I_1 = I_{OUT} + I_2$ is derived from the previously stated relation $I_1 - I_2 = I_{OUT}$.

It will be seen from the above that the power source current ($I_1$) is determined by the sum of $I_{OUT}$ and $I_2$ and, therefore, $I_2$ should be as small as possible in order to use the power source for the image transfer purpose as efficiently as possible. On the other hand, when the resistance of the belt 5 remains the same, the current distribution is inversely proportional to the distances $L_2$ and $L_3$. Therefore, a relation $L_3 \geqq L_2$ should hold as far as possible. When an experiment was conducted with a relation $L_3 > L_2$, the capacity of the power source and, therefore, the image transfer was found short. Further, since the power source is often built in a unit, the capacity thereof, i.e., the space for accommodating it cannot be increased beyond a certain limit. In this respect, too, the contact plate 12 for controlling the potential of the belt 5 and the above-mentioned positional relation are indispensable.

Figure 5:
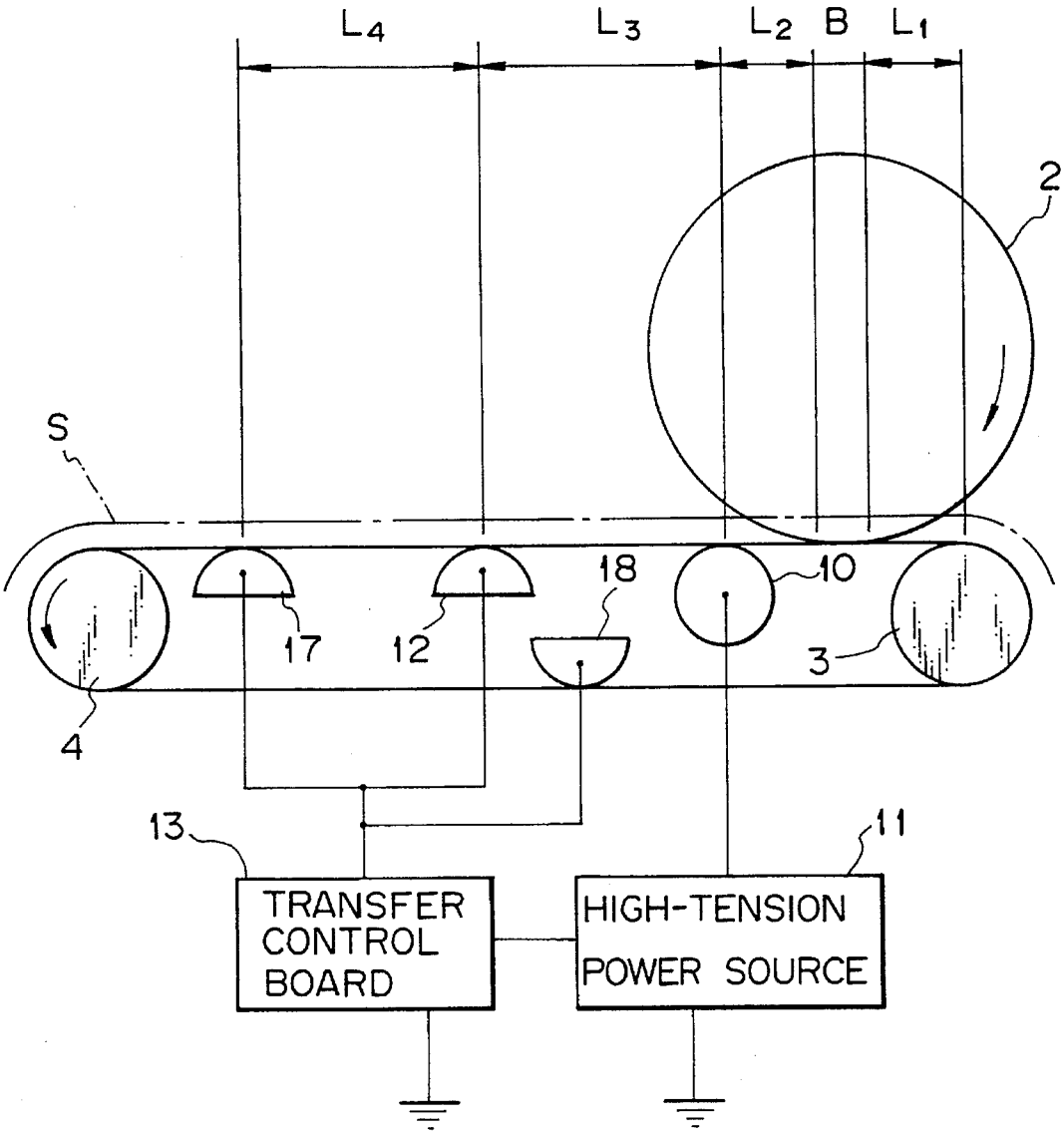
FIG. 5 is indicative of a positional relation of a driven roller, a bias roller and contact plates included in the embodiment.

As shown in FIG. 5, a second contact plate 17 may be located downstream of the contact plate 12 in the direction of sheet transport. In such a case, the contact plates 12 and 17 are spaced apart by a distance $L_4$ which insures the discharge of the belt 5 having the time constant $\tau = C.R$. The distance $L_4$ depends on the process speed v of the belt 5 and is selected to satisfy a relation:

$$\tau \leqq L_4 / v$$

In this case, $\tau$ indicates a period of time necessary for the belt 5 to be discharged, as counted from the time when the belt 5 has moved away from the first contact plate 12.

Specifically, considering the separation of the sheet from the belt 5, it is necessary to surely discharge the belt 5. When the belt 5 moved away from the second contact plate 17 is not fully discharged, the discharge of the belt 5 over the distance from the contact plate 17 and the separation position solely depends on the time constant of the belt 5. Therefore, only if the discharge depending on the time constant of the belt 5 is completed when the belt 5 has moved away from the contact plate 17, the belt 5 will be fully discharged. Such a relation is also desirable when the linear velocity (process speed) of the belt 5 is taken into account.

Figure 6:
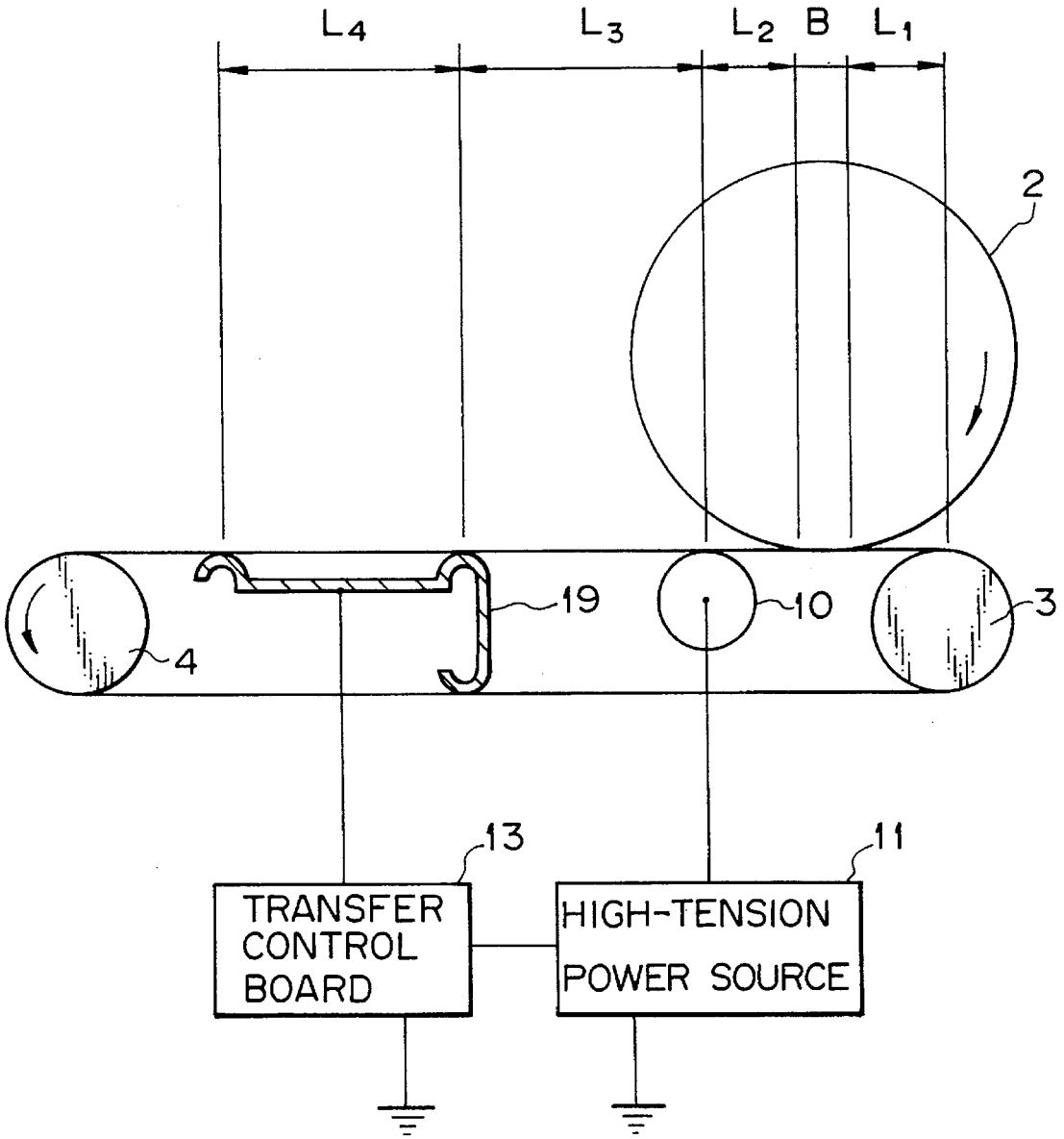
FIG. 6 shows a modified configuration of the contact plates of FIG. 5.
Figure 7:
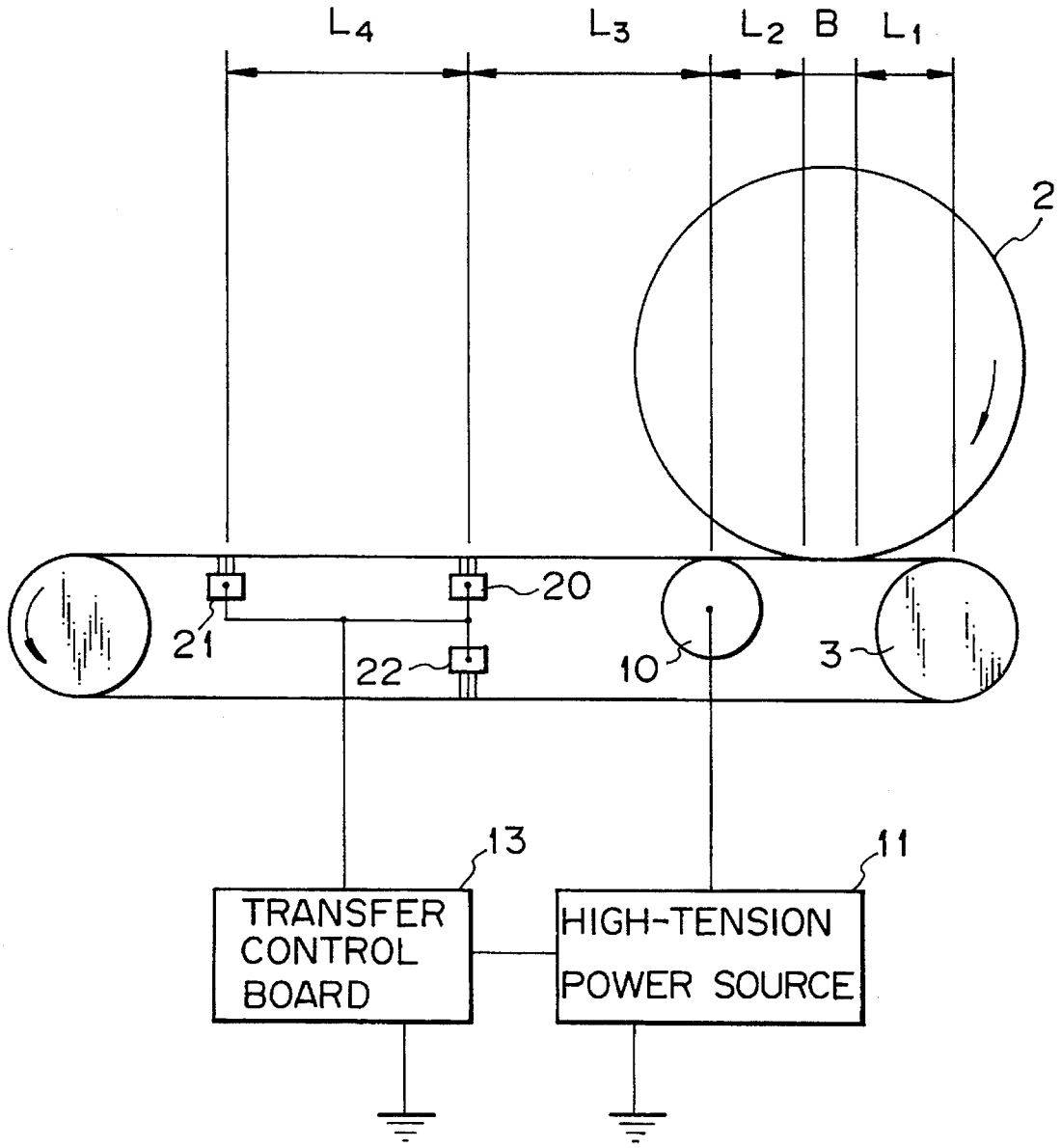
FIG. 7 shows another specific configuration of the contact plates of FIG. 5.

As also shown in FIG. 5, a third contact plate 18 may be held in contact with the inner surface of the lower run of the belt 5 which is opposite to the upper run for carrying the sheet S. The contact plate 18 serves the same function as the other contact plates 12 and 17. As shown in FIG. 6, the contact plates 12, 17 and 18 may be implemented as a single contact member 19 formed of a sheet metal, if desired. Further, as shown in FIG. 7, the contact plates 12, 17 and 18 may be respectively constituted by conductive brushes 20, 21 and 22 in order to reduce the contact resistance.

A reference will be made to FIGS. 8–14 for describing specific arrangements for preventing the current to flow to the photoconductive element from changing due to a change in the resistance of the transfer belt, a change in the property of the sheet, etc.

Figure 8:
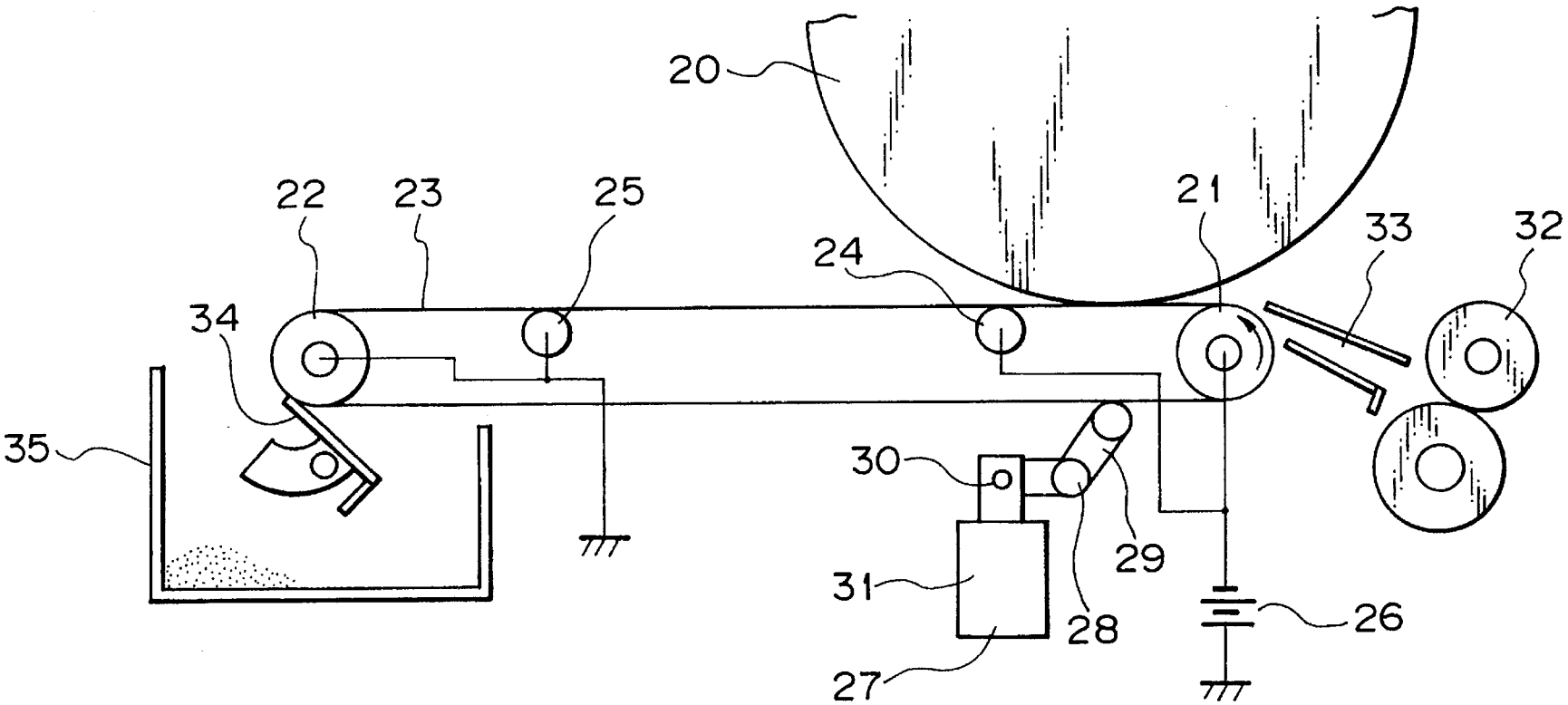
FIG. 8 shows a specific arrangement for maintaining a difference between a current to flow to the transfer belt and a current to flow to ground constant.

In FIG. 8, a photoconductive drum, or image carrier, 20 is rotatable. Arranged around the drum 20 are a discharger for discharging the drum 20, a charger for charging the drum 20, an exposing section for forming an electrostatic latent image on the drum 20 by light, a cleaning unit for cleaning the drum 20 and other conventional process units, although not shown in the figure. A transfer belt 23 is disposed below the drum 20 and passed over a conductive drive roller 21 and a conductive driven roller 22. The upper run of the belt 23 is supported by conductive rollers 24 and 25 from the rear. The drive roller 21 is connected to a motor, not shown, and rotated in a direction indicated by an arrow in the figure. The rollers 21 and 24 are connected to a power source 26 to play the role of contact electrodes contacting the belt 23. The roller or contact electrode 24 is located downstream of a nip portion between the drum 20 and the belt 23 with respect to an intended direction sheet transport. Specifically, the roller 24 is positioned such that a charge is not injected into a sheet before the sheet reaches a position where it faces the drum 20, as in the arrangement of FIG. 1. Again, this is successful in preventing a sheet from wrapping around the drum 20. The other rollers 22 and 25 are connected to ground. The belt 23 is formed of a dielectric material having a resistance of $10^6$ Ω to $10^{12}$ Ω, particularly 9 to $9.4\times10^7$ Ω in the embodiment.

The belt 23 is selectively brought into or out of contact with the drum 20 by a mechanism 27 including a lever 29 and a solenoid 31. The lower end of the lever 29 is rotatably connected to a plunger 30 extending out from the solenoid 31. The lever 29 supports the belt 23 at the upper end thereof and is rotatable about a shaft 28. A sheet guide 33 extends from a register roller, or sheet transporting means, 32 to the drive roller 21. A cleaning blade 34 is disposed in a top-open waste toner container 35 and urged against the driven roller 22 with the intermediary of the belt 23 to remove a toner remaining on the belt 23.

Figure 9:
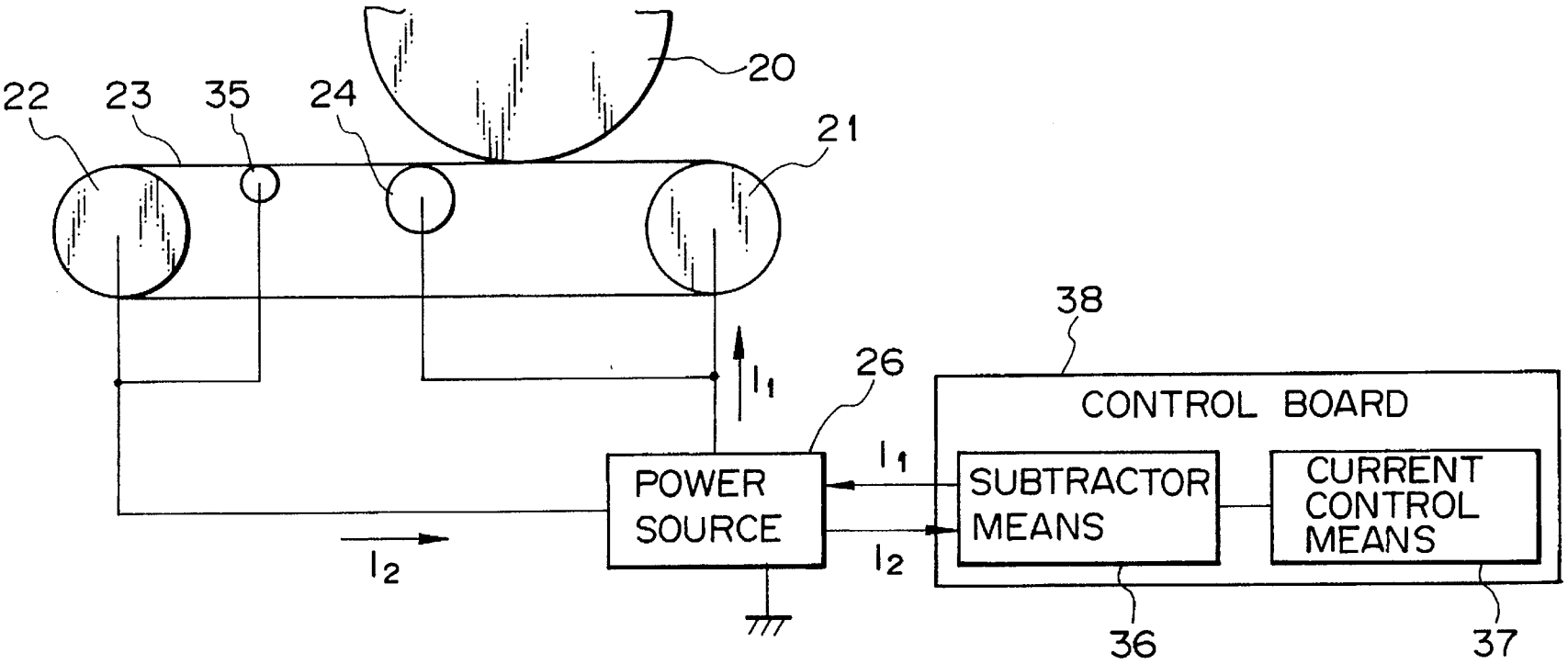
FIG. 9 is a schematic block diagram associated with FIG. 8.

As shown in FIG. 9, assume that a current $I_1$ is fed from the power source 26 to the belt 23 via the drive rollers or contact electrodes 21 and 24, and that a current $I_2$ flows from the belt 23 to ground via the rollers 22 and 25. A control board 38 includes subtractor means 36 and current control means 37. The subtractor means 36 subtracts the current $I_2$ from the current $I_1$. The controller 37 controls the current from the power source 26 to the rollers 21 and 24 such that the residual produced by the subtractor means 36 remains constant, i.e., at 30 μA in this case.

In operation, a sheet, not shown, is brought to a stop at the nip portion of the register roller 32 and then driven to between the drum 20 and the belt 23 in synchronism with the rotation of the drum 20. At this instant, the solenoid 31 is energized to cause the lever 29 to bring the belt 23 into contact with the drum 20. In FIG. 9, a current is fed from the power source 26 to the dielectric belt 23 via the rollers 24 and 24 while the belt 23 is driven by the roller 21 to transport the sheet to the left. Since the belt 23 has a resistance of 9 to $9.4\times10^7$ Ω, as stated earlier, the current is prevented from being immediately flowing to ground. Hence, a charge required for image transfer can be deposited on the belt 23 in the vicinity of the drum 20. In addition, the current control means 37 controls the current to the belt 23 such that the difference between the current $I_1$ to the belt 23 and the current $I_2$ to ground remains constant, as also stated previously. It follows that although the resistance of the belt 23 may change, the current to flow from the belt 23 to the drum 20 remains constant to in turn maintain the charge required for image transfer substantially constant between the drum 20 and the belt 23. As a result, the quality of a transferred image is enhanced.

Figures 10A, 10B:
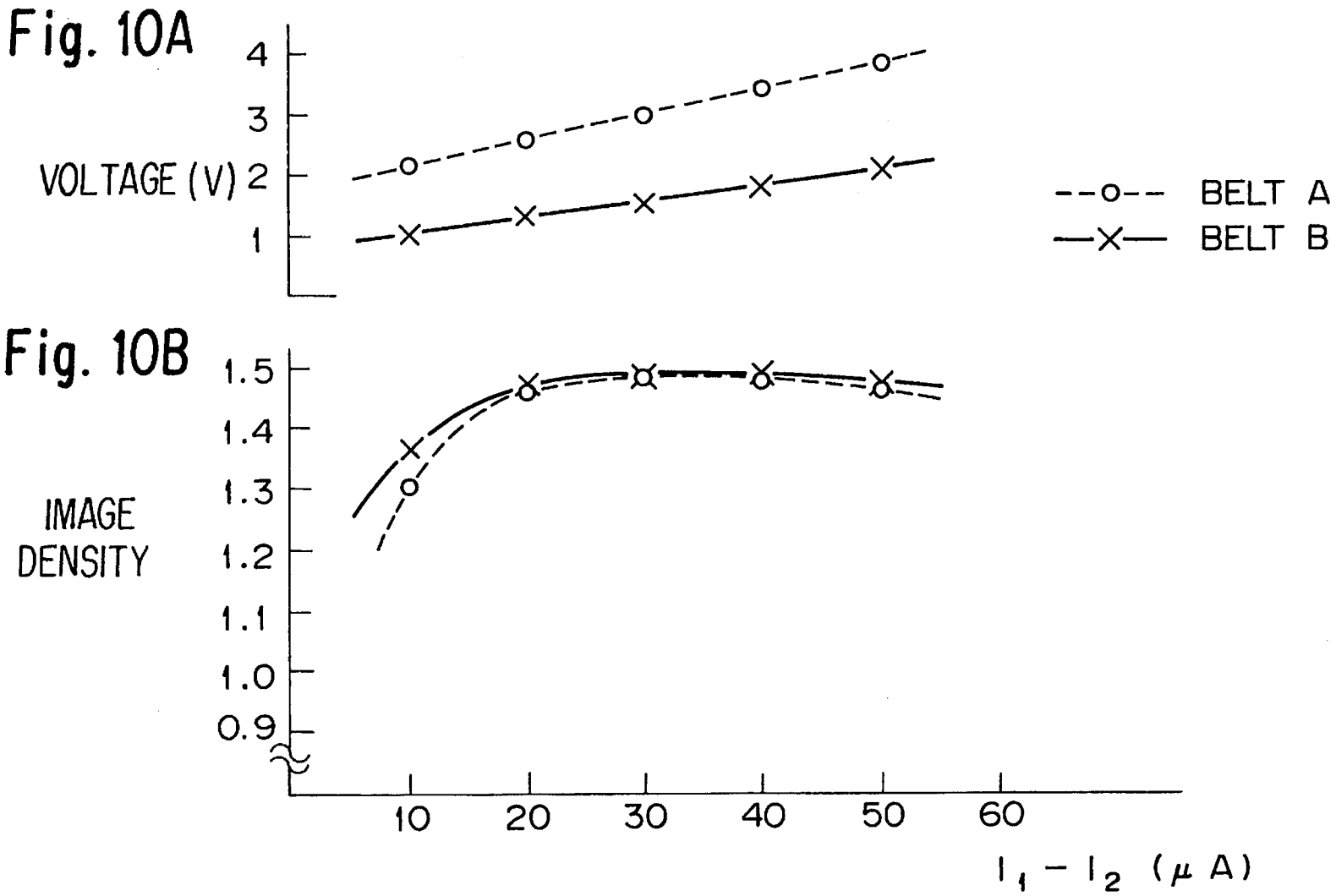
FIG. 10(*a–b*) plots a relation between a current and a voltage and image density with respect to different transfer belts and particular to the arrangement of FIG. 8.
Figures 11A, 11B:
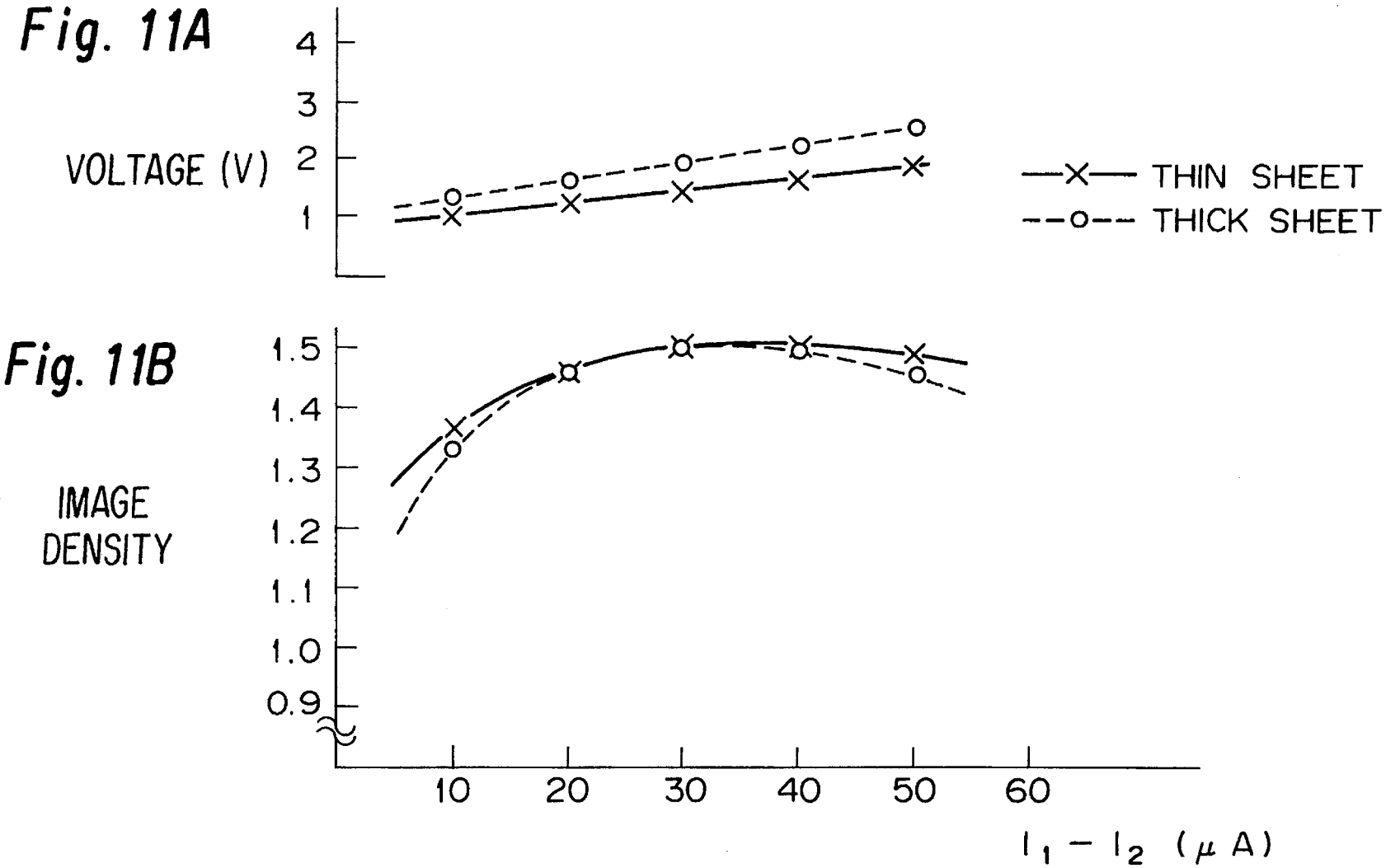
FIG. 11(*a–b*) plots a relation between a current and a voltage and image density with respect to different sheets and also particular to the arrangement of FIG. 8.
Figures 12A, 12B:
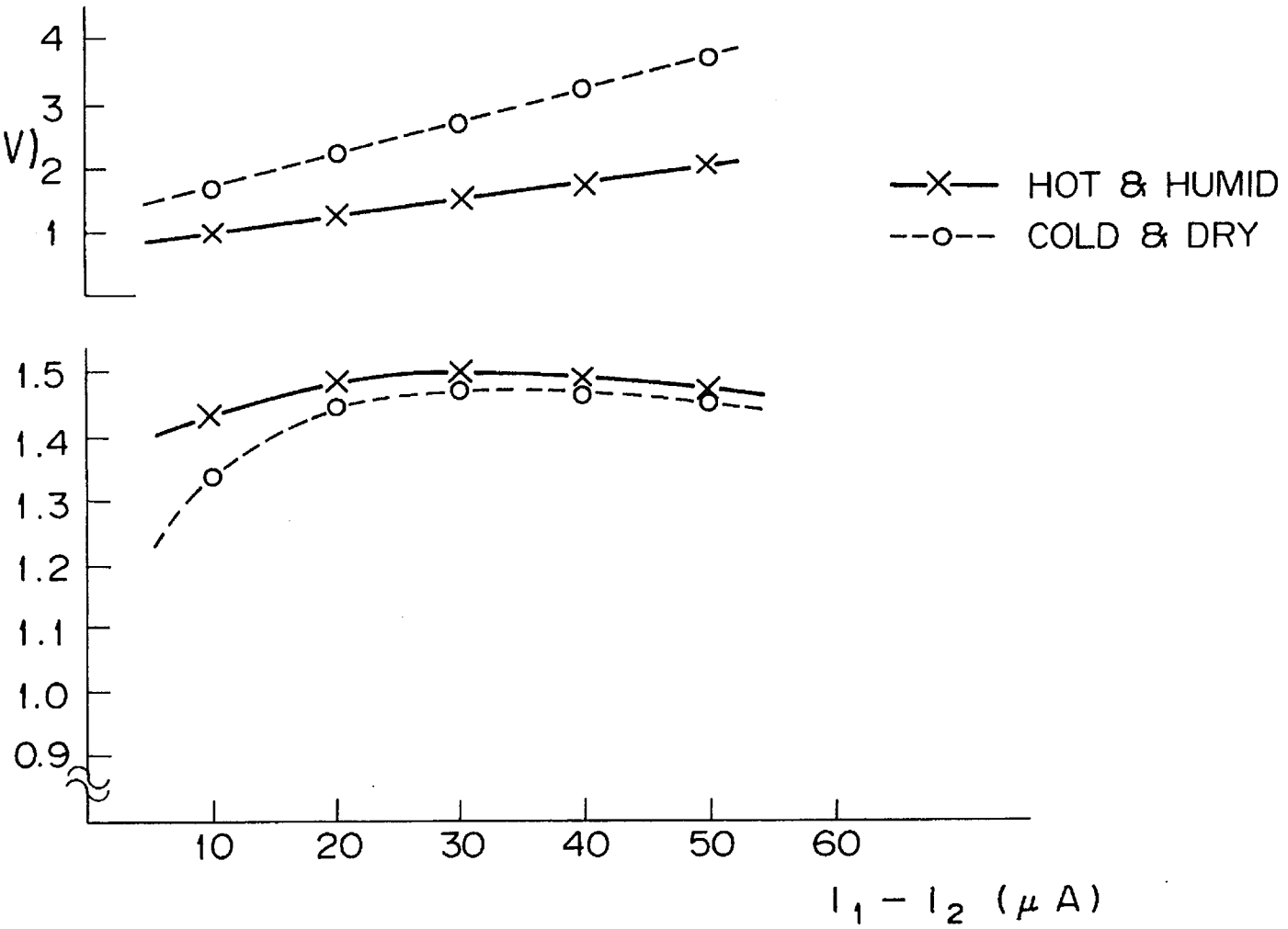
FIG. 12(*a–b*) plots a relation between a current and a voltage and image density with respect to different environments and also particular to the arrangement of FIG. 8.

FIGS. 10–12 show experimental data for supplementing the above description of the operation. In the figures, the abscissa and the ordinate indicate respectively the difference between the currents $I_1$ and $I_2$ and the voltage applied to the belt 23 together with image density. Specifically, in FIG. 10, dotted curves and solid curves indicate respectively data derived from belts A and B each having a particular resistance.

FIG. 11 is indicative of a relation between the difference between the currents $I_1$ and $I_2$ and the voltage and image density. Solid curves and dotted curves are respectively associated with a thin sheet and a thick sheet each having a particular conductivity characteristic.

FIG. 12 shows a relation between the difference between the currents $I_1$ and $I_2$ and the voltage and image density with respect to different environments. Solid curves and dotted curves are respectively associated with a high temperature and high humidity environment and a low temperature and low humidity environment.

The driven roller 22 is provided with a diameter as small as about 14 mm to 16 mm, as stated earlier. Hence, the sheet carrying an image transferred from the drum 20 and being transported by the belt 23 is separated from the belt 23 due to its own elasticity and then driven out to the left. The separation of the sheet from the belt 23 is further enhanced since, as the sheet moves away from the drum 20, the charge on the belt 23 is dissipated due to the conductivity of the belt 23. When the sheet moves away from the nip portion of the drum 20, the solenoid 31 is deenergized to lower the lever 29. As a result, the belt 23 is moved away from the drum 20 to protect the drum 20 from deterioration.

If desired, a particular range of voltage which the power source 27 can apply may be set, and means for detecting a change in the voltage may be provided. Then, when the voltage is brought out of the particular range, alarm means, not shown, may produce an alarm. Specifically, when a leak occurs at a location other than between the power source and the associated member or when the current fails to flow to the belt 23, the detecting means will detect such an occurrence and cause the alarm means to produce and alarm.

Figure 13:
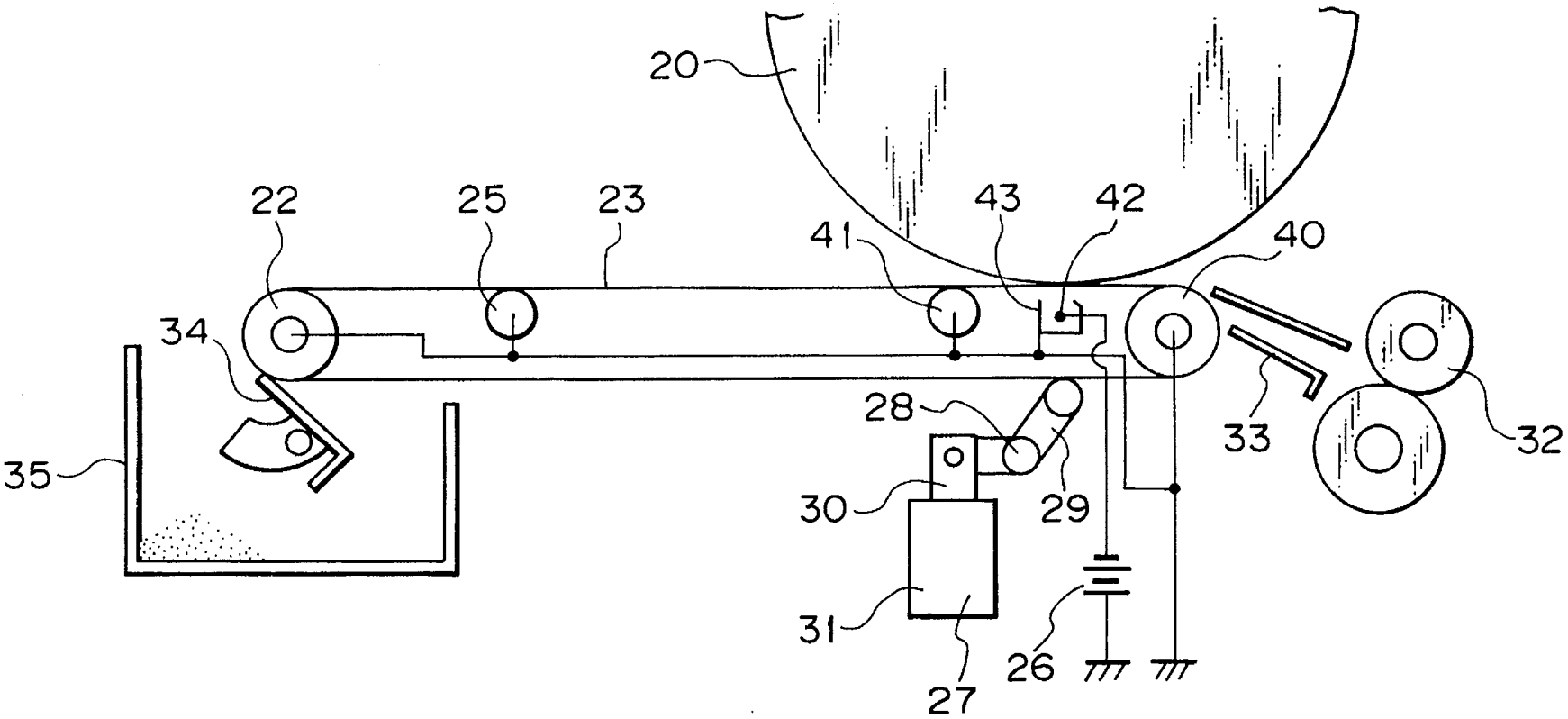
FIG. 13 is a section showing a modification of the arrangement of FIG. 8.

FIG. 13 shows a structure using a corona charger 42 for charging the belt 23. As shown, the belt 23 is driven by a driven roller 40. A roller 41 supports the belt 23 in the vicinity of the drum 20. The rollers 40 and 41 are made of a conductive material and connected to ground together with the driven roller 22 and roller 25. The corona charger 42 faces the inner surface of the belt 23 immediately below the drum 20 and has a wire and a casing 43. The wire is connected to the power source 26 while the casing 43 is connected to ground.

Figure 14:
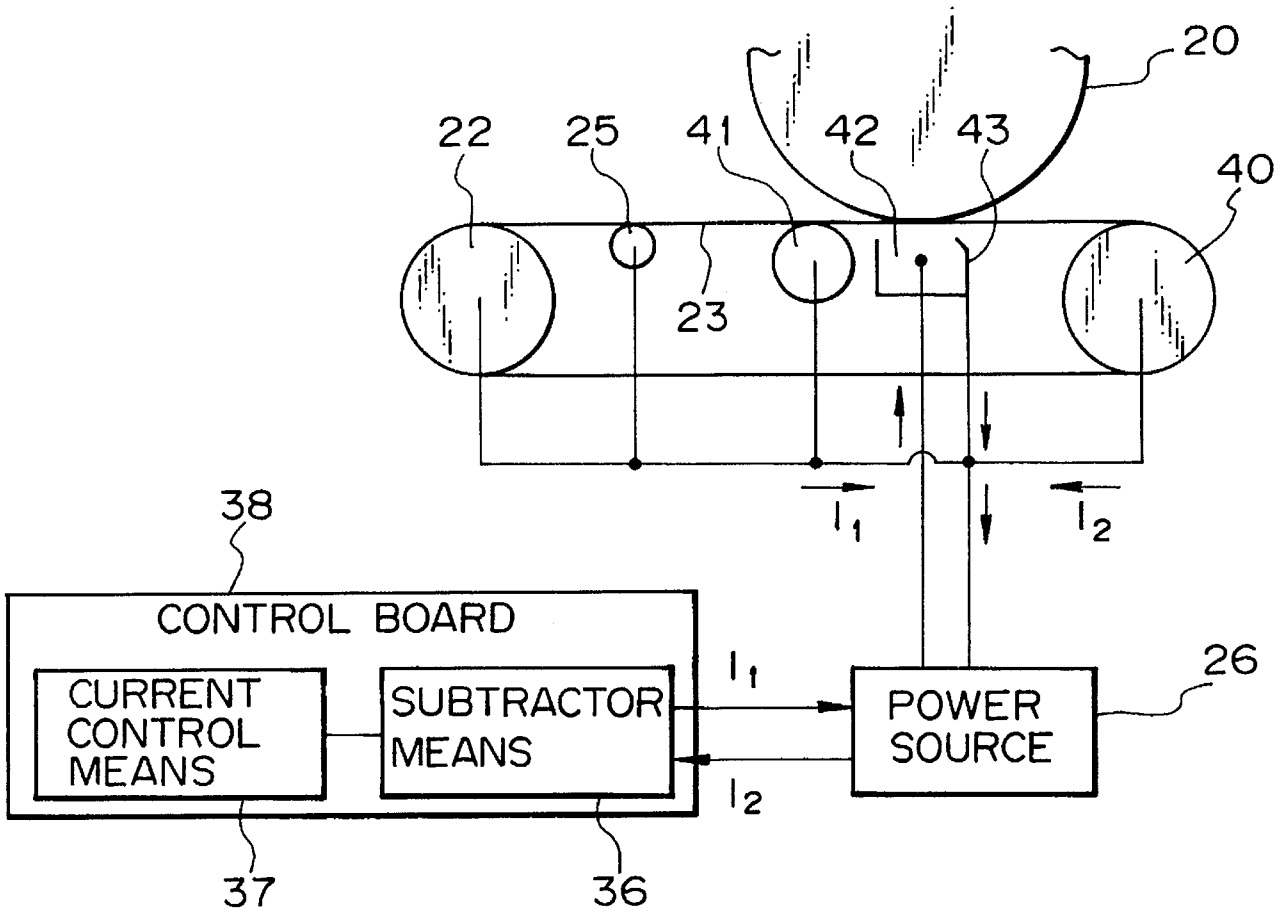
FIG. 14 is a schematic block diagram associated with FIG. 13.

As shown in FIG. 14, assume that a current $I_1$ is fed from the power source 26 to the wire of the corona charger 42, and that the sum of the current to flow from the casing 43 to ground and the current to flow from the belt 23 to ground via the rollers 22, 25, 40 and 41 is $I_2$. The control board 38 has the subtractor means 36 for subtracting $I_2$ from $I_1$, and the current control means 37 for controlling the current from the power source 26 to the corona charger 42 such that the residual remains constant (30 μA).

In operation, as a sheet is transported by the drum 20 and belt 23, the corona charger 42 effects a discharge toward the belt 23 to deposit a charge on the belt 23. At this instant, since the belt 23 has a resistance of 9 to $9.8\times10^7$ Ω, the charge is prevented from being immediately released to ground. Hence, a charge required for image transfer can be deposited on the belt 23 in the vicinity of the drum 20. Moreover, the current control means 37 controls the current from the power source 26 to the corona charger 42 such that the difference between the current I1 flown to the wire of the charger 42 and the currents I2 to flow from the casing 43 and belt 23 to ground remains constant. It follows that although the resistance of the belt 23 may change, the charge to be deposited from the belt 23 on the drum 20 can be maintained constant to in turn maintain the charge required for image transfer substantially constant between the drum 20 and the belt 23. As a result, the quality of a transferred image is enhanced.

The operation described above is also proved by the data shown in FIGS. 10–12. In this embodiment, the voltage and current shown in FIGS. 10–12 are similarly applicable to the corona charger 32. Regarding the effects, this embodiment is substantially comparable with the previous embodiment.

In summary, the present invention provides a guide for determining a positional relation between members constituting an image transferring device as well as the materials of such members, and positions the members on the basis of the guide. Hence, when a transfer bias for setting the surface potential of a sheet is applied, there are eliminated the dielectric breakdown of a photoconductive element and that of a transfer belt and noise otherwise introduced in electric control circuitry. It follows that the transfer bias and discharge for preventing a sheet from wrapping around the photoconductive element and from being incompletely separated from the transfer belt can function effectively.

In accordance with the present invention, current control means controls a current from a power source to a contact electrode such that a current to flow from the transfer belt to the photoconductive element remains constant. Therefore, a charge required for substantial image transfer is maintained constant between the photoconductive element and the transfer belt although various factors including the environment, the property of a sheet, the resistance of the transfer belt and the area of an image may change. This enhances the quality of image transfer. Moreover, since the contact electrode used to achieve such an advantage is located at a position where a charge is not injected into a sheet before the sheet reaches the photoconductive element, the transfer of the true charge to the sheet is delayed to prevent the sheet from wrapping around the photoconductive element and from being incompletely separated.

Furthermore, the current control means controls the current from the power source to the contact electrode such that a difference between a current to the transfer belt and a current to ground remains constant. Therefore, despite that the resistance of the belt may change, a charge required for substantial image transfer is maintained constant between the photoconductive element and the transfer belt. Since a contact member is provided for detecting a current to flow to ground, it is possible to determine a current to the transfer belt and a current to ground with accuracy.

In addition, a particular range of voltage which the power source can apply may be set in order to produce an alarm when the voltage does not lie in such a range. This surely eliminates an occurrence that no current is fed to the transfer belt to render the image transfer defective.

Figure 31:
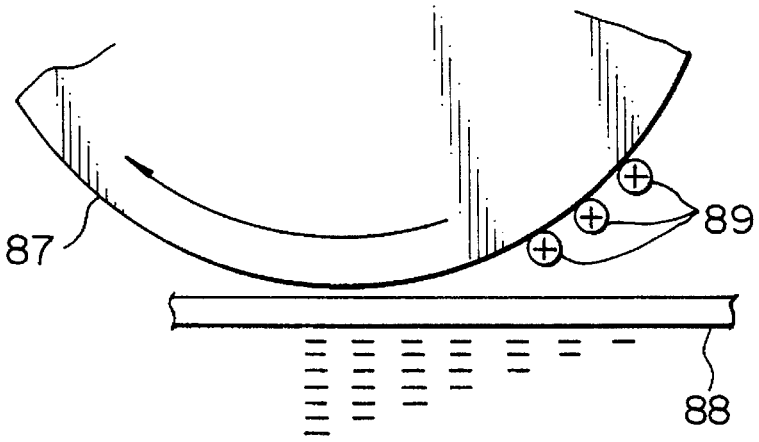
Fig. 31 PRIOR ART
FIGS. 31 and 32 are views showing problems particular to a conventional image forming apparatus.
Figure 32:
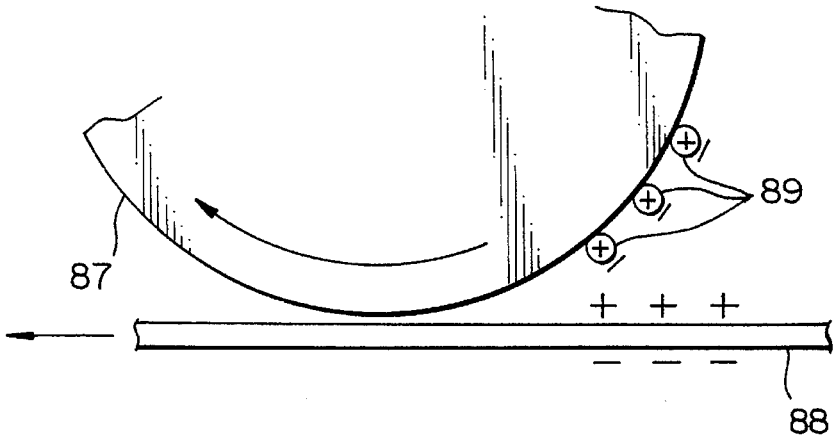
Fig. 32 PRIOR ART

A reference will be made to FIGS. 31 and 32 for discussing problems particular to a conventional contact type transfer and separation system for an image forming apparatus. The contact type image transfer and sheet separation system is advantageous over the corona type system in that it reduces ozone and requires only a low power source voltage, as discussed earlier. However, the problem with a transfer belt is that the adequate bias voltage to be applied from a power source to the belt changes due to various causes including irregularities in the resistance of the belt, varying ambient conditions, kind of sheets, and area of a toner image. This prevents a toner image from being desirably transferred from the belt to a sheet. Specifically, the amount of charge deposited on the belt by the bias potential from the power source deviates from one required to effect desirable image transfer due to irregularities in the resistance of the belt ascribable to the production line, changes in the resistance ascribable to the varying ambient conditions, changes in the material and thickness of sheets, etc. More specifically, as shown in FIG. 31, when the amount of charge required to effect desirable image transfer is deposited on a transfer belt, discharge does not occur in a pretransfer region upstream of the nip portion between a photoconductive element 87 and the belt. In this condition, a toner 89 charged to positive polarity, for example, is transferred to a sheet 88 carried on the belt in a transfer region. In this case, a bias potential is applied from a power source, not shown, to the belt 88. As shown in FIG. 32, when the actual amount of charge on the belt is deviated from the expected one due to the above-stated reasons, discharge occurs in the pretransfer region. This causes a negative charge to deposit on the toner 89 and thereby charges the front and the rear of the belt to positive polarity and negative polarity, respectively. As a result, despite that the bias potential from the power source is adequate, the toner 89 is prevented from being transferred from the photoconductive element 87 to the sheet 88, resulting in the local omission of an image on the sheet.

Figure 16:
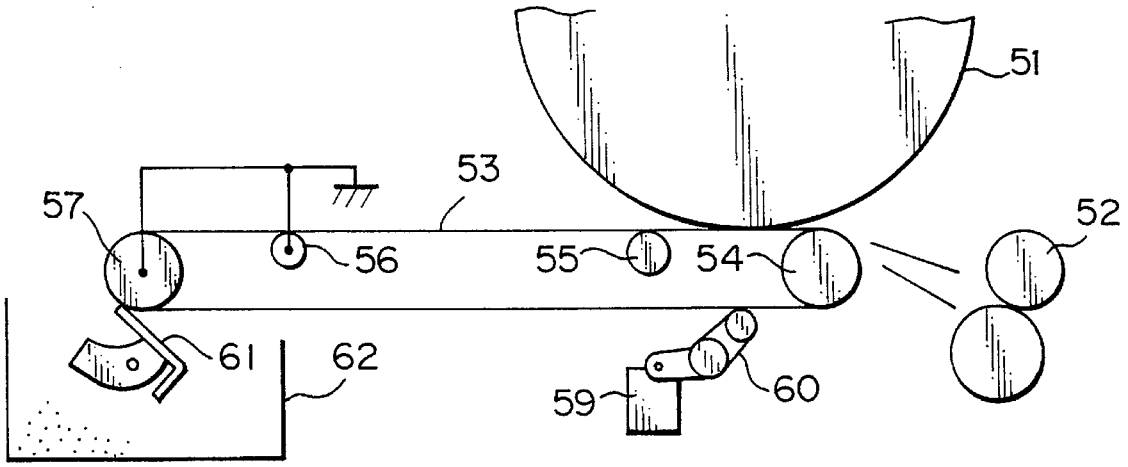

Referring to FIG. 16, part of an image forming apparatus embodying the present invention is shown and implemented as an electrophotographic copier. As shown, the apparatus includes an image carrier in the form of a photoconductive drum 51. The drum 51 is uniformly charged by a main charger while being rotated by a drive mechanism, not shown. A writing device writes image data on the charged surface of the drum 51 to form an electrostatic latent image. A developing unit develops the latent image to produce a corresponding toner image. A recording medium in the form of a sheet is fed from a sheet feed device to a register roller 52, brought to a stop for a moment, and then driven toward a transfer belt 53 in synchronism with the toner image formed on the drum 51. At least the front of the transfer belt 53 is made of a dielectric material.

The transfer belt 53 is passed over a drive roller 54 and driven rollers 55–57. The rollers 56 and 57 are connected to ground. The roller 55 plays the role of a bias roller or bias electrode while the roller 54 remains in an electrically floating state. As soon as the leading edge of the sheet approaches a portion where the drum 51 and transfer belt 3 are to contact, a solenoid 59 is energized to urge a lever 60 upward. The lever 60 in turn raises one side of the belt assembly, i.e., the belt 53 and rollers 54–57 until the belt 53 contacts the drum 51.

Figure 15:
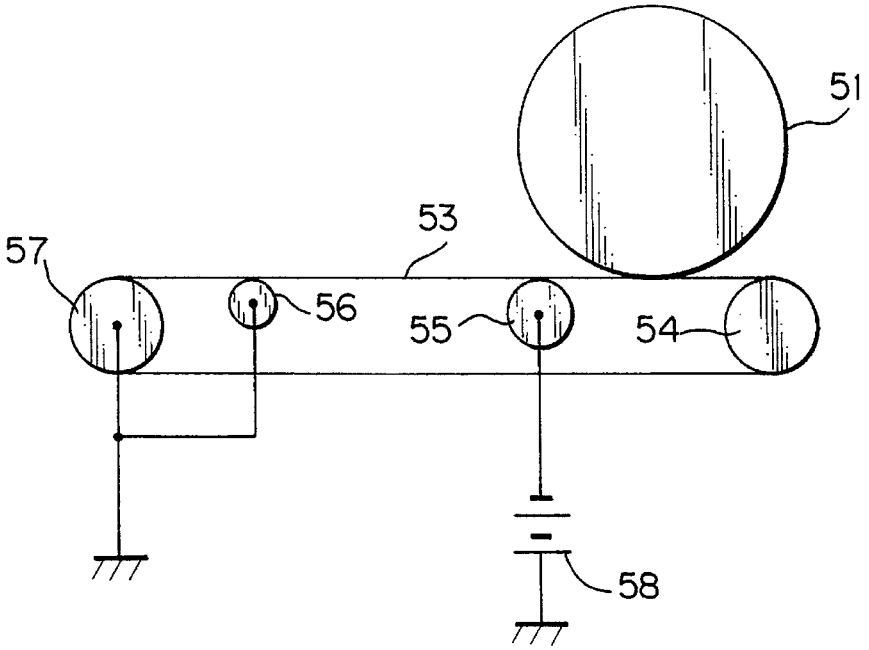
FIGS. 15 and 16 are respectively a fragmentary front view and a section showing an image forming apparatus embodying the present invention.
Figure 23:
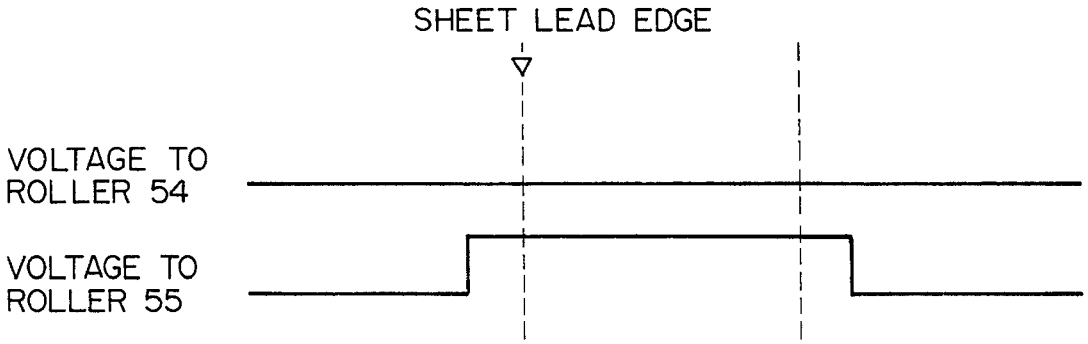
FIG. 23 is a timing chart demonstrating a specific operation of the embodiment shown in FIGS. 15 and 16.

The drive roller 54 is driven by a motor to in turn rotate the transfer belt 53. The belt 53 contacts the drive roller 54 at a position upstream of the portion where it is capable of contacting the drum 51, and contacts the bias roller 55 at a position downstream of the contact portion. The belt 5 3 contacts the drum 51 over a predetermined nip width. As shown in FIGS. 15 and 23, when the belt 53 contacts the drum 51, a power source 58 applies to the bias roller 55 a predetermined bias voltage whose polarity is opposite to the polarity of the toner deposited on the drum 51, thereby depositing a corresponding charge on the belt 53. The belt 53 is made of a material having a specific volume resistivity ($10^6$ Ωcm to $10^{12}$ Ωcm). Hence, a current flows toward the rollers 56 and 57 due to the bias voltage from the bias roller 55, resulting in the fall of voltage.

While the sheet is transported between the belt 53 and the drum 51, the toner image is transferred from the drum 51 to the sheet due to the above-mentioned bias voltage applied from the power source 58 to the belt 53. The sheet is polarized by the charge applied from the power source 58 to the belt 53. The polarizing voltage of the sheet and the true charge of the belt 53 generate an electrostatic force. As a result, the sheet is conveyed by the belt 53 while being electrostatically adhered to the belt 53.

While the sheet is conveyed by the belt 53, the charge thereof is reduced by being released to ground via the belt 53 and rollers 56 and 57. The rate at which the charge of the sheet decreases greatly depends on the resistance R and capacitance C of the sheet and is determined in terms of a time constant $\tau=R\cdot C$. The sheet is transported toward a fixing station by the belt 53. As the sheet approaches the inlet of the fixing station, the charge thereof is reduced to in turn reduce the electrostatic force acting between the sheet and the belt 53. Consequently, the sheet is separated from the belt 53 by the roller 57 connected to ground and having a small diameter and the elasticity of the sheet. Then, the toner image carried on the sheet is fixed at the fixing station. Preferably, the roller 57 has a diameter ranging from 14 mm to 16 mm.

As soon as the trailing edge of the sheet moves away from the nip portion between the drum 51 and the belt 53, the solenoid 59 is deenergized to retract the lever 60 and, therefore, the belt assembly including the belt 53 and rollers 54–57. As a result, the belt 53 is brought out of contact with the drum 51. This is to protect the drum 51 from deterioration while the transfer of a toner image is not performed.

While the belt 53 is in rotation, the toner scattered around from the drum 51 without being transferred to the sheet is directly deposited on the belt 53. This part of the toner has the charge thereof reduced by the rollers 56 and 57 connected to ground and then scraped off by a cleaning blade 61 into a collecting bottle 62.

Figure 17:
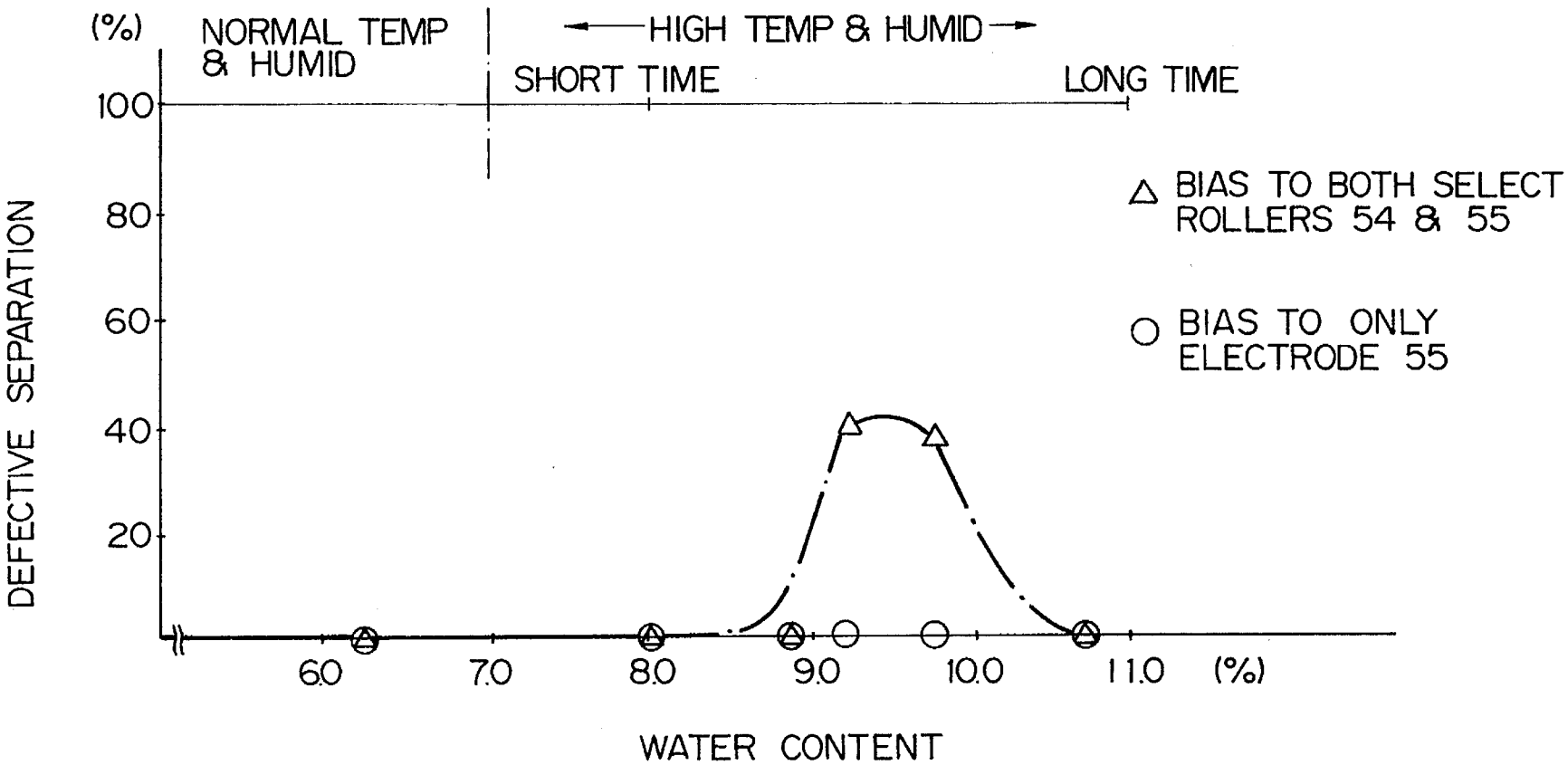
FIG. 17 is a graph indicative of the results of experiments.

In the illustrative embodiment, only the bias roller 55 deposits a charge on the belt 53. When the bias voltage from the power source is applied not only to the bias roller 55 but also to the drive roller 54, the potential distribution on the belt 53 has a linear gradient in a portion T between the rollers 54 and 55. Experiments showed that the belt 53 fails to electrostatically retain a sheet thereon as the water content of the sheet is as great as 8% to 11% due to a hot and humid environment. By contrast, when the bias voltage is applied only to the bias roller 55 as shown in FIG. 23, the embodiment insures the separation of the sheet from the drum 1 as shown in FIG. 17. This is presumably because when the charge is applied by the drive roller 54 contacting the belt 53 at a position upstream of the drum 51, the charge penetrates into the leading edge of the sheet as the water content of the sheet increases, preventing the sheet from electrostatically adhering to the belt 53.

When the drive roller 54 does not apply a charge to the belt 53 as in the embodiment, a charge does not penetrate into the leading edge of a sheet being transported by the belt 53. Hence, a repulsive force is not generated between the belt 53 and the sheet which would prevent the sheet from being fully separated from the drum 51.

Figure 18:
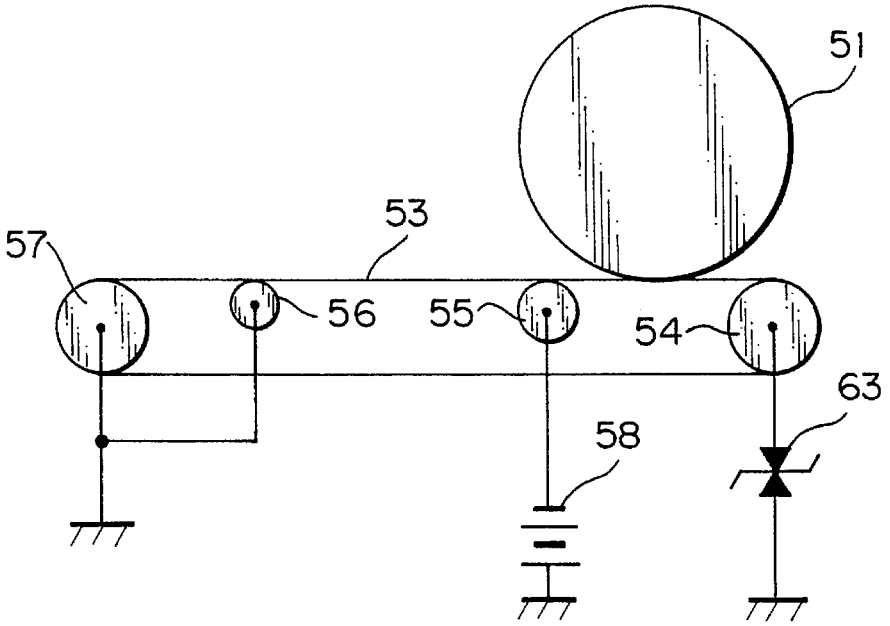
FIGS. 18–22 are front views each showing an alternative embodiment of the present invention.

FIG. 18 shows an alternative embodiment of the present invention. As shown, the drive roller 54 plays the role of a bias roller or bias electrode at the same time. The drive roller 54 is connected to ground via a varistor, Zener diode or similar constant voltage element 63. While the bias voltage to be applied to the bias roller is open to choice, it should preferably be close to the bias voltage to be applied to the downstream bias roller 55.

Specifically, in this embodiment, the bias voltage from the power source 58 is applied to the downstream bias roller 55. The upstream bias roller 54 is maintained at substantially the same potential as the downstream bias roller 55. This is successful in maintaining the potential at the position where the drum 51 and belt 53 contact stable and, therefore, insuring desirable toner image transfer with no regard to, for example, irregularities in the resistance of the belt 53. In addition, the charge injection into the sheet in a humid environment is reduced to promote sure separation of the sheet from the drum 51. Particularly, since this embodiment is even more stable than the first embodiment regarding the transfer of the toner image, the bias voltage to be applied from the power source 58 to the bias roller 55 can be low.

Figure 19:
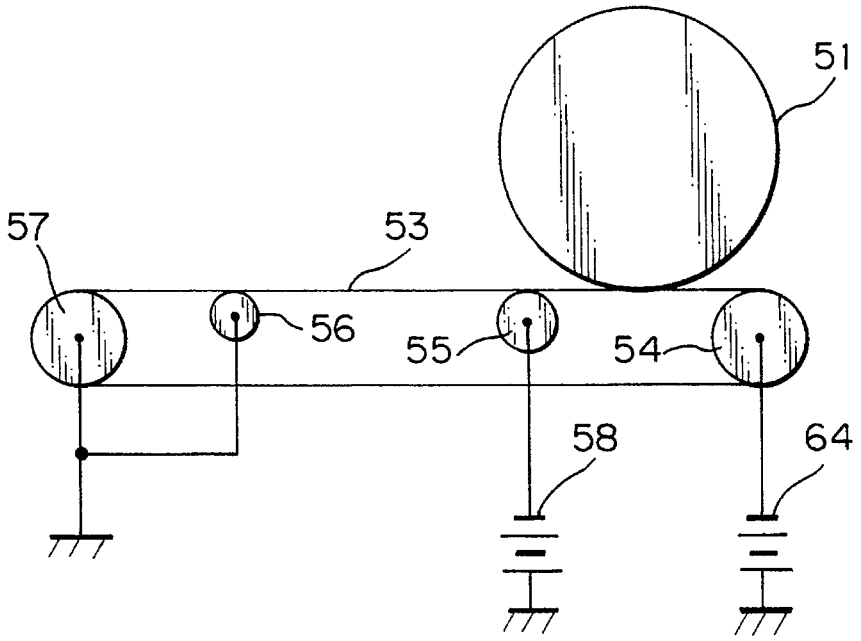
Figure 24:
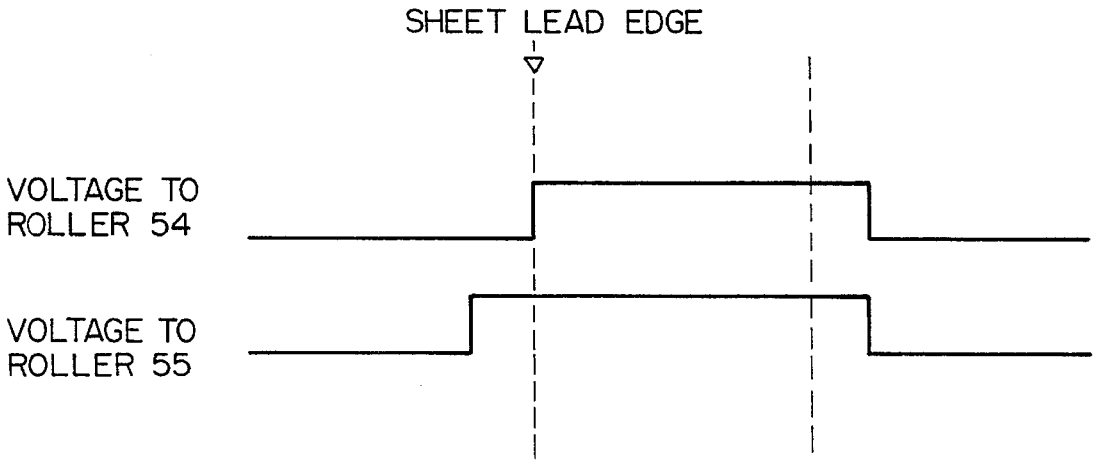
FIG. 24 is a timing chart representative of a specific operation of the embodiment shown in FIG. 19.
Figure 33:
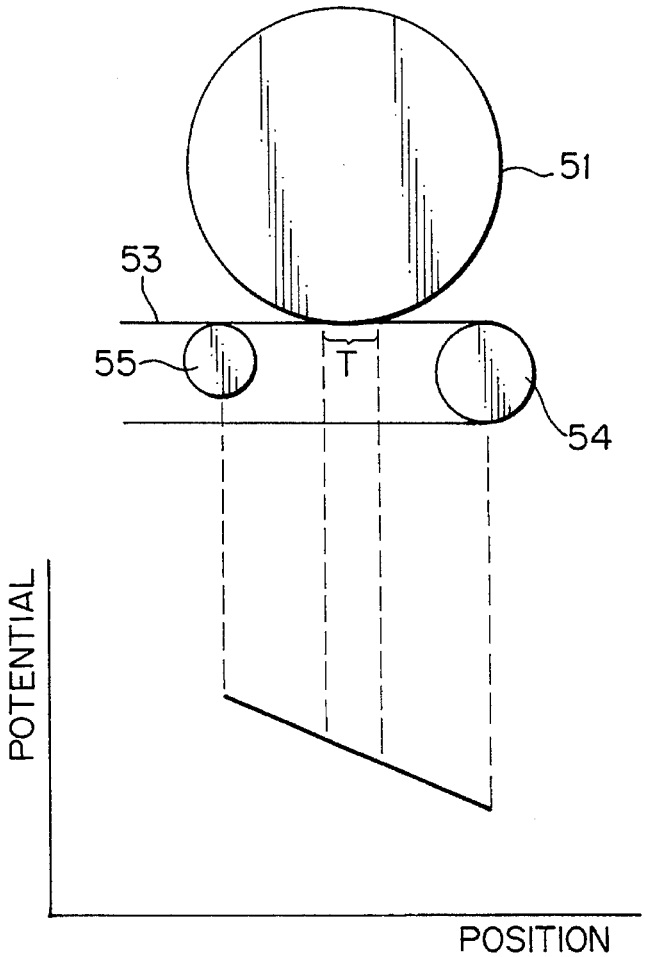
FIGS. 33, 34 and 35 are graphs indicative of, respectively, potential distributions particular to the embodiments shown in FIGS. 15 and 16, FIG. 20, and FIG. 21.

Referring to FIG. 19, another alternative embodiment of the present invention will be described which is similar to the embodiment of FIG. 16 except for the following. The drive roller 54 plays the role of a bias roller or bias electrode. As shown in FIG. 24, a power source 64 starts applying a bias voltage to the drive roller 54 at the time when the sheet enters the nip portion between the drum 51 and the belt 53 and contacts the drum 51. Again, as shown in FIG. 33, the potential distribution of the belt 53 has a linear gradient in the portion T.

This embodiment, like the embodiment of FIG. 16, enhances the separation of the sheet from the drum 51 and transfers the toner image to the sheet stably with no regard to irregularities in the resistance of the belt 53. Consequently, the belt 53 can be produced and selected at a high yield.

Figure 20:
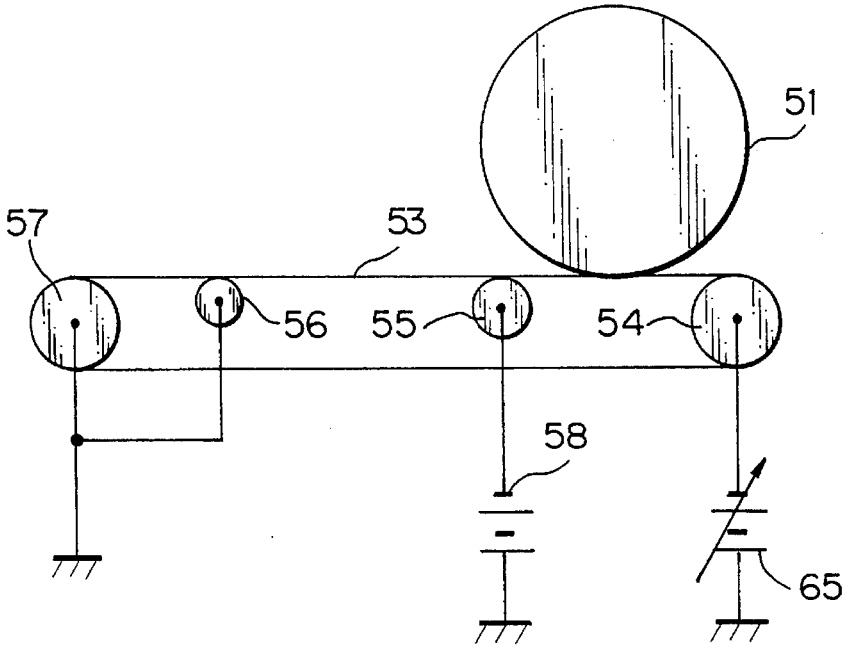
Figure 25:
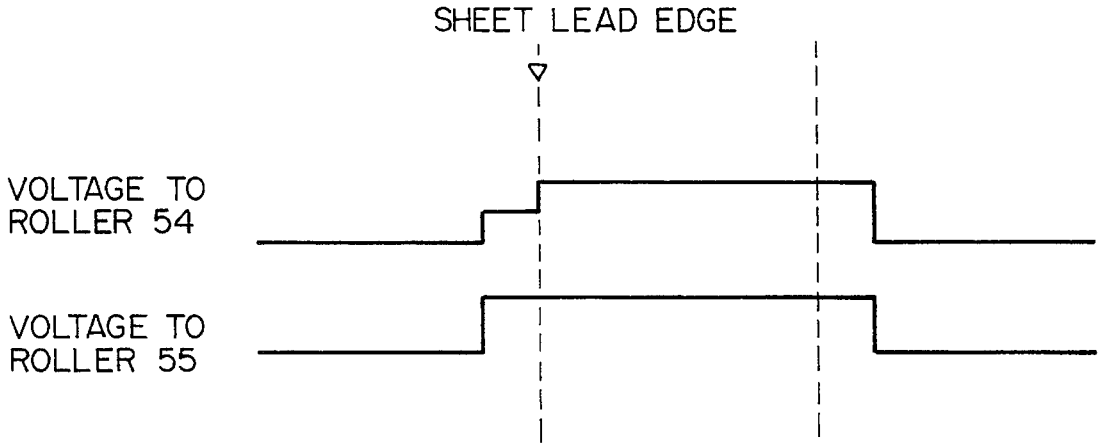
FIG. 25 is a timing chart representative of a specific operation of the embodiment shown in FIG. 20.
Figure 34:
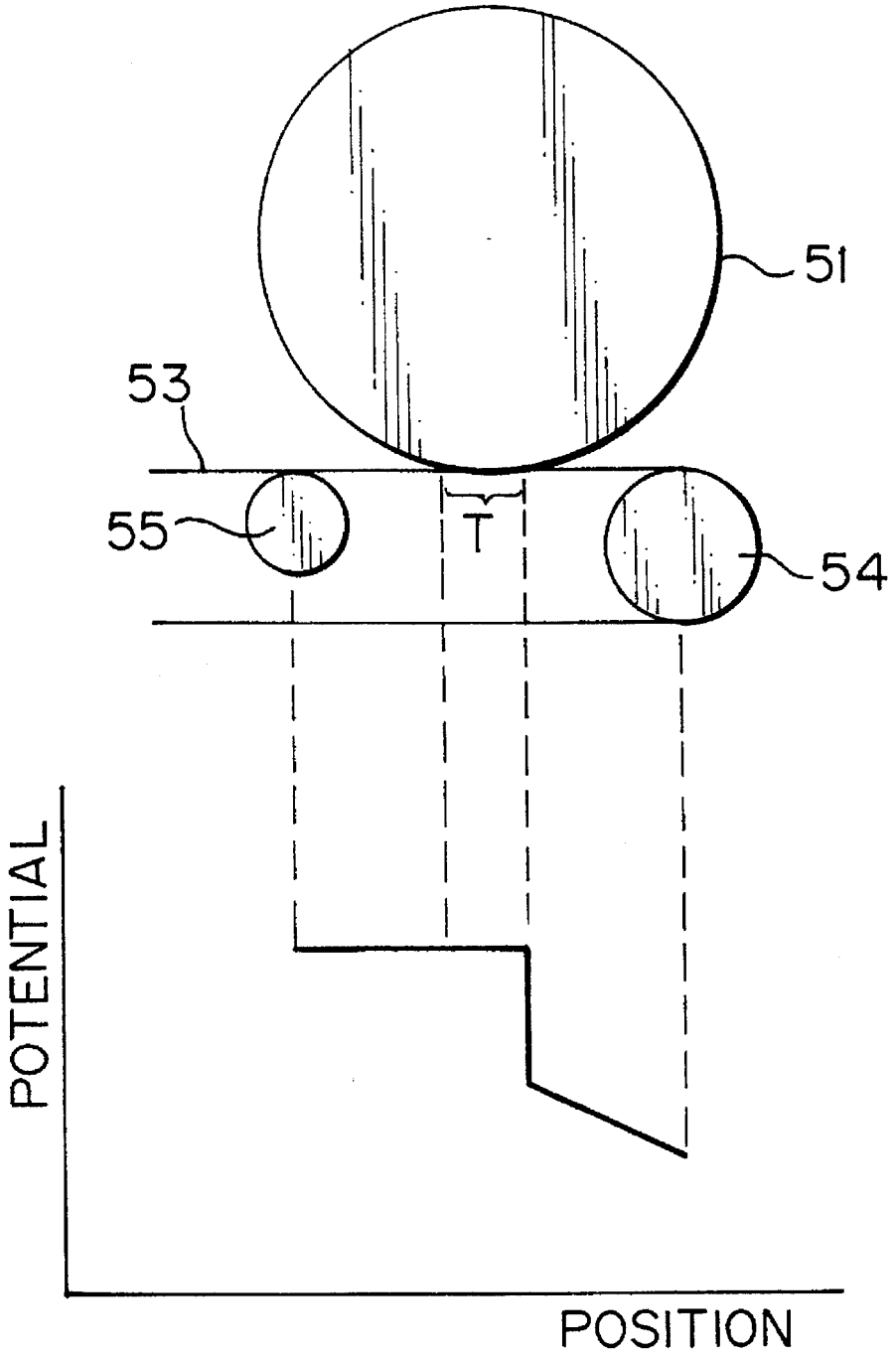

FIG. 20 shows another alternative embodiment of the present invention which is similar to the embodiment of FIG. 19 except for a variable power source 65 substituted for the power source 64. As shown in FIG. 25, the variable power source 65 applies a bias voltage lower than the bias voltage to the bias roller 55 to the bias roller 54 and at the same time as the voltage to the bias roller 55. As soon as the leading edge of the sheet enters the nip portion between the drum 1 and the belt 53, the power source 65 applies the same bias voltage as applied to the bias roller 55 to the bias roller 54. The resulting potential distribution of the belt 53 is shown in FIG. 34.

As stated above, this embodiment maintains the bias voltage to the bias roller 54 lower than the bias voltage to the bias roller 55 until the leading edge of the sheet enters the nip portion between the drum 51 and the belt 53. This also enhances the separation of the sheet from the drum 51.

Figure 21:
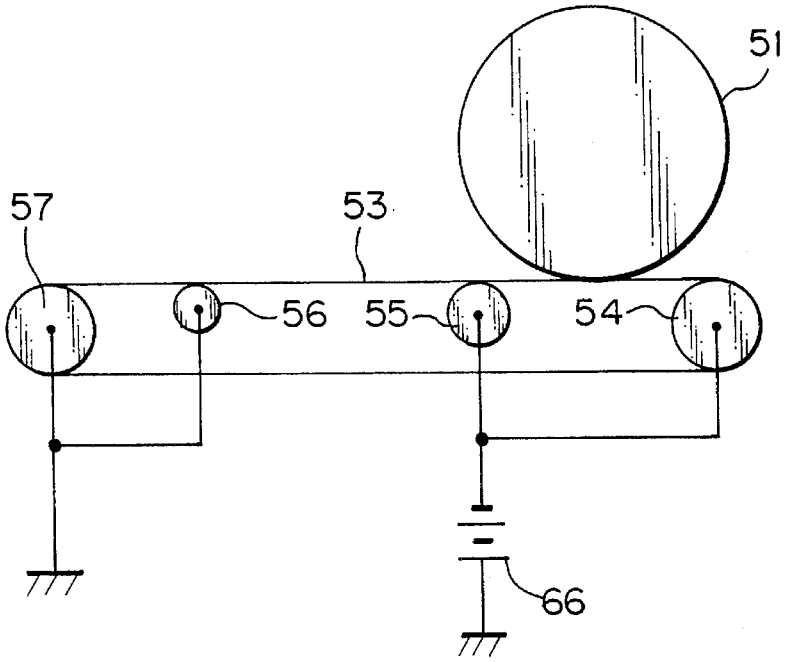
Figure 26:
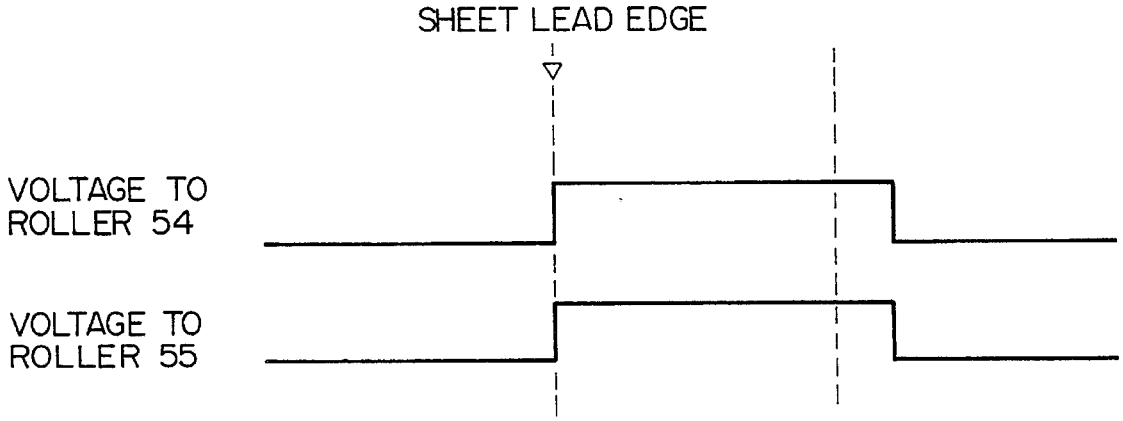
FIG. 26 is a timing chart demonstrating a specific operation of the embodiment shown in FIG. 21.
Figure 35:
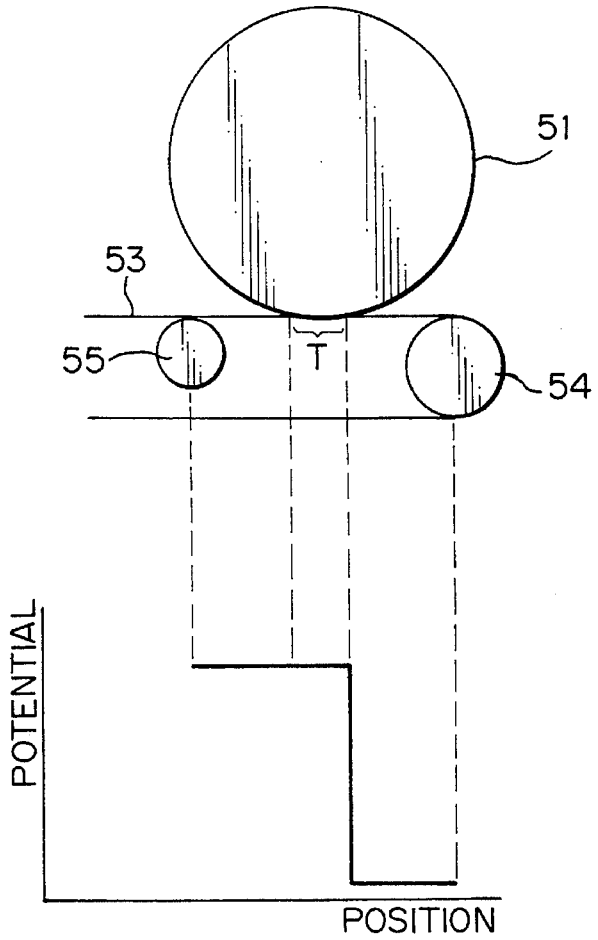

FIG. 21 shows another alternative embodiment of the present invention which is similar to the embodiment of FIG. 16 except that a power source 66 applies a bias voltage to the bias rollers 54 and 55 at a timing shown in FIG. 26. Specifically, the power source 66 starts applying a bias voltage to the bias rollers 54 and 55 at the time when the leading edge of the sheet has moved a predetermined distance shorter than 8 mm away from the nip between the drum 51 and the belt 53. As a result, the toner image is not transferred to the sheet over the predetermined distance as measured from the leading edge thereof. Specifically, the sheet is simply left blank over several millimeters as measured from the leading edge thereof. However, the sheet is surely separated from the belt 53 at the inlet of the fixing station, causing the toner image to be fixed there. In this case, the belt 53 has a potential gradient shown in FIG. 35.

Figure 22:
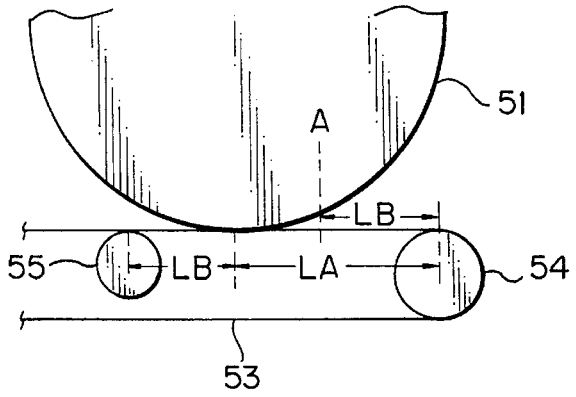

FIG. 22 is representative of another alternative embodiment corresponding to the embodiments of FIGS. 19– 21, respectively. As shown, in the these embodiments, the distance LA between the nip portion between the drum 51 and the belt 53 and the bias roller 54 is selected to be longer than the distance LB between the nip portion and the bias roller 55. The power source 58, 65 or 66 starts applying the bias voltage to the bias roller 54 or 55 when the leading edge of the sheet has moved to a point A which is downstream of the roller 54 by the distance LB. Such alternative embodiments are also successful in surely separating the sheet from the drum 51.

Another alternative embodiment of the present invention is similar to the third embodiment of FIG. 19 except that the time for applying the bias voltage to the bias roller 54 is adjustable at the outside of the apparatus. While the embodiment of FIG. 19 starts applying the bias voltage to the bias roller 54 from the power source 64 after the sheet has contacted the drum 51, it is likely that the sheet transport control differs from one machine to another or changes within the same machine due to the wear of a sheet transport system. When the time for applying the bias voltage to the upstream bias roller 54 is too early, a charge is apt to deposit on the belt 53 before the sheet contacts the drum 51, making the separation of the sheet from the drum 51 unstable in a humid environment. Conversely, when the above-mentioned time is too late, the bias voltage from the power source 64 is applied to the bias roller 54 after the leading edge of the sheet has moved away from the nip portion between the drum 51 and the belt 53. Then, it is likely that the toner image cannot be surely transferred to the leading edge portion of the sheet when the belt 53 has a resistance component. In the light of this, this embodiment allows the time for applying the bias to the bias roller 54 to be changed at the outside of the apparatus.

Figure 27:
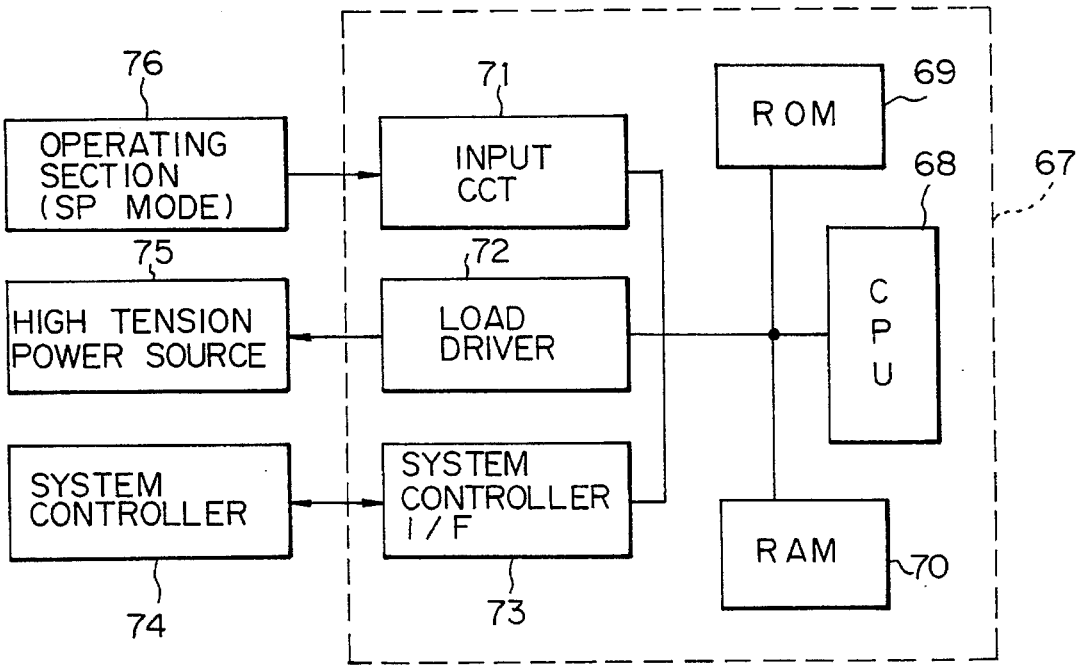
FIGS. 27 and 28 are block diagrams each schematically showing another alternative embodiment of the present invention.

FIG. 27 shows circuitry for implementing this embodiment. As shown, a main control section 67 has a CPU (Central Processing Unit 68, a ROM (Read Only Memory) 69, a RAM (Random Access Memory) 70, an input circuit 71, a load driver 72, and a system control interface (I/F) 73. A system controller 74, a high tension power source 75 and an operating section (SP mode) 76 are connected to the main control section 67. A serviceman, for example, manipulates the operating section 76 to condition the apparatus for a serviceman program (SP) mode and again manipulates it to enter an adjusting value associated with the application of the bias voltage to the bias roller 54.

The ROM 69 stores a program according to which the CPU 68 operates. As a signal indicative of the SP mode is entered on the operating section 76 and applied to the CPU 68 via the input circuit 71, the CPU 68 sets up the SP mode. When the adjusting value associated with the application of the bias voltage is entered on the operating section 76, it is written to the RAM 70 which is backed up by a battery. The CPU 68 adjusts the time for applying the bias voltage to the bias roller 54 from the power source 64 via the load driver 72 on the basis of the adjusting value stored in the RAM 70. If desired, in the embodiments of FIGS. 20–22, the time for applying the the bias to the upstream bias roller 54 may also be adjusted at the outside of the apparatus to insure both of sure image transfer and sure sheet separation.

Figure 28:
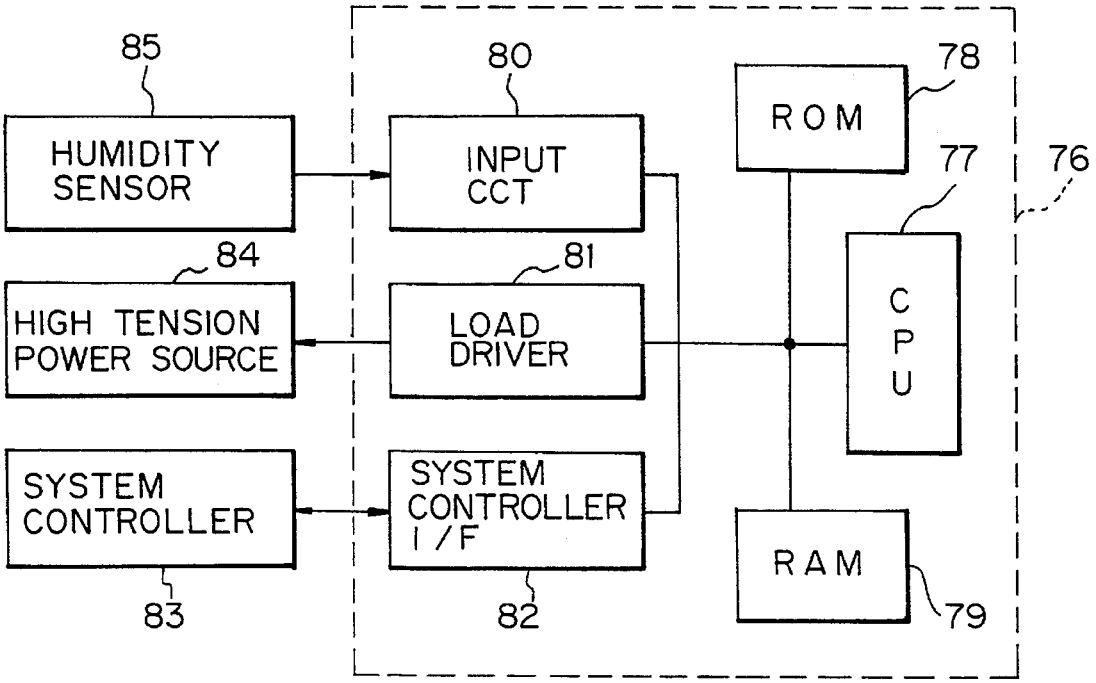

Referring to FIG. 28, circuitry representative of another alternative embodiment of the present invention is shown. As shown, a main control section 76 has a CPU 77, a ROM 78, a RAM 79, an input section 80, a load driver 81, and a system control I/F 82. A system controller 83, a high tension power source 84 and a humidity sensor 85 are connected to the main control section 76. Located in close proximity to the sheet feed device, the humidity sensor senses humidity around sheets stacked in the sheet feed device. During an ordinary mode operation (e.g. during copying), as the humidity sensor 85 sends a humidity signal to the CPU 77 via the input circuit 80, the CPU 77 determines whether or not the sensed humidity is higher than a predetermined humidity, e.g., 70% in terms of relative humidity. If the actual humidity is higher than the predetermined one, the CPU 77 retards the time for applying the bias voltage to the bias roller 54 from the power source 64 via the load driver 81, i.e., causes the power source 64 to start applying the bias voltage to the roller 54 after the sheet has contacted the drum 51.

When the sensed humidity is lower than 70%, the CPU 77 causes the power source 64 to start applying the bias voltage to the bias roller 54 at the same time as the power source 58 applies the bias voltage to the bias roller 55 via the load driver 81. In this configuration, even when the water content of the sheet is high due to high humidity, the charge injection from the upstream bias roller 54 into the sheet does not occur, so that the sheet is stably separated from the drum 51. After the leading edge of the sheet has been separated from the drum 51, the bias rollers 54 and 55 inject charges into the sheet. Hence, the toner image is stably transferred to the sheet at the rear of the leading end portion of the belt 53. So long as the humidity is lower than 70%, the separation of the sheet from the drum 51 is satisfactory. Since the bias rollers 54 and 55 sequentially deposit a charge on the sheet, the toner image is stably transferred from the leading edge toward the trailing edge of the sheet at all times.

The above-stated advantages of this embodiment are also achievable with an absolute humidity sensor in place of the relative humidity sensor. If desired, the humidity sensor may be used in combination with a temperature sensor to control the time for applying the bias voltage from the power source 64 to the bias roller 54. Further, the humidity sensor scheme of this embodiment is also applicable to the embodiments of FIGS. 20–22, if desired.

Figure 29:
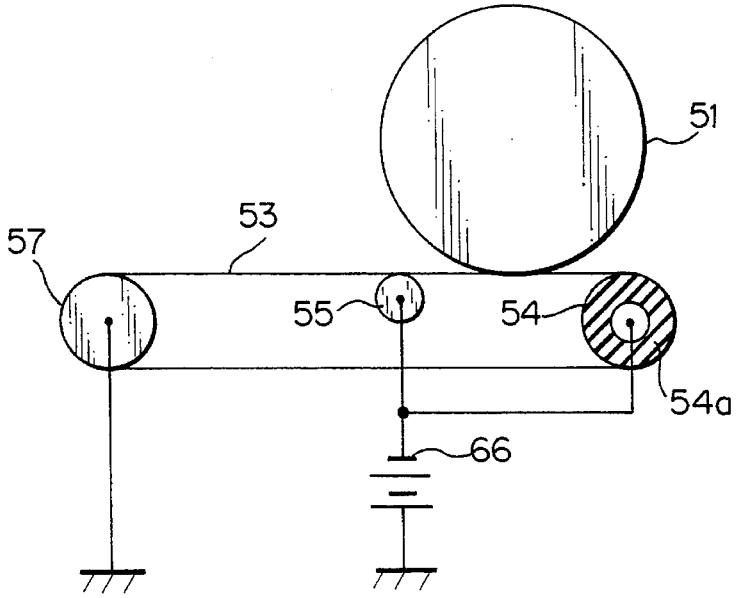
FIGS. 29 and 30 are front views each showing another alternative embodiment of the present invention.

FIG. 29 shows another alternative embodiment which is similar to the embodiment of FIG. 21 except that the bias roller 54 is provided with a surface layer 54*a* made of a dielectric material. The surface layer 54*a* has a specific volume resistivity of, for example, $10^6$ Ωcm to $10^{12}$ Ωcm and a thickness of 0.2 mm to 3 mm. The rollers 55 and 57 contacting the belt 53 at positions downstream of the drum 51 are made of metal. As the power source 66 applies a voltage to the bias rollers 54 and 55, the rollers 54 and 55 sequentially deposit a voltage on the belt 53 to maintain the potential at the portion where the belt 53 contacts the drum 51 stable, thereby insuring desirable transfer of the toner image. Since the bias roller 55 deposits a charge on the belt 53 more efficiently than the bias roller 54, the charge injection from the upstream bias roller 54 into the sheet sparingly occurs in a humid environment. This promotes sure separation of the sheet from the drum 51 in such a humid environment. Again, as shown in FIG. 33, the potential distribution of the belt 53 has a linear gradient in the portion T between the portions where the rollers 54 and 55 contact the belt 53.

Figure 30:
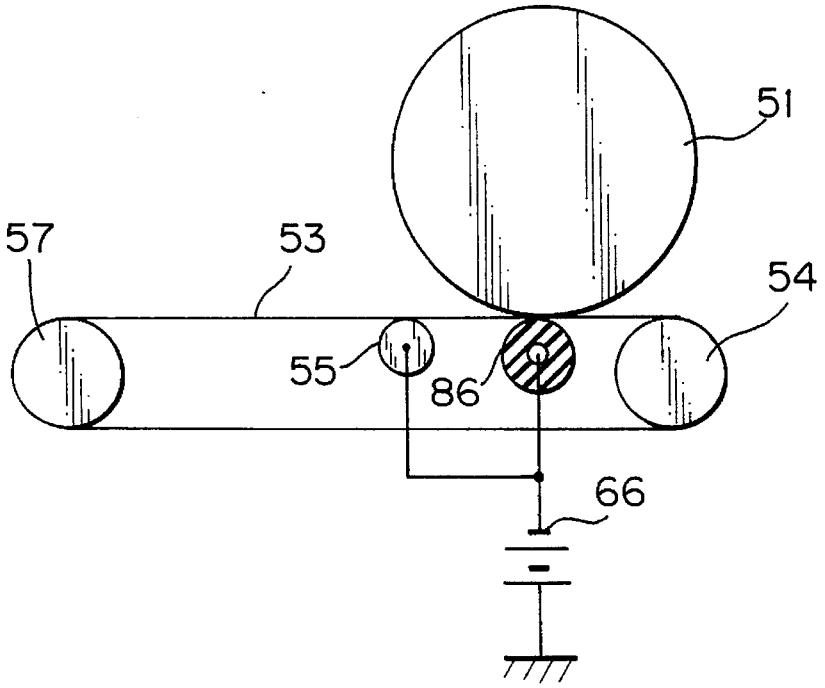

FIG. 30 shows another alternative embodiment of the present invention. As shown, this embodiment is similar to the embodiment of FIG. 29 except that a bias roller 86 is held in contact with the rear of the belt 53 at the position where the belt 53 contacts the drum 51, and in that the power source 66 applies a voltage to a bias roller 86 as well as to the roller 55. The bias roller 86 has a surface layer made of an elastic dielectric material. For example, the surface layer of the roller 86 is made of a material having a specific volume resistivity of $10^6$ Ωcm to $10^{12}$ Ωcm and a hardness less than 50° in terms of modulus hardness and provided with a thickness of greater than 51 mm. As shown in FIG. 33, the potential of the belt 53 linearly changes in the portion T between the portions where the rollers 54 and 55 contact the belt 53.

As the power source 66 applies a voltage to the bias rollers 86 and 55, the rollers 86 and 55 each efficiently deposits a charge on the belt 53 even when the transfer voltage in the position where the belt 53 contacts the drum 51 is low. High transfer voltages are apt to cause an image to be locally omitted when transferred to a sheet. Since the surface layer of the bias roller 86 has a medium resistance, there can be eliminated the damage to the bias roller 86 and belt 53 due to the leakage of the charge and, therefore, the resulting defective image transfer. Moreover, since the charge deposition on the belt 53 by the bias rollers 86 and 55 does not occur at the upstream side with respect to the transfer station, no charges are injected into the sheet in a humid environment before the image transfer, insuring positive sheet separation.

In the embodiments shown and described, the transfer belt 53 may be replaced with a transfer roller, if desired. The transfer roller is as effective as the belt 53 regarding the stable sheet separation and, in addition, frees the sheets from the trace of a separator, creases and jams.

Other alternative embodiments to be described pertain to an image forming apparatus of the type including a carrier which transports a toner transferred thereto by the first transferring step to the second transferring step. The carrier may be implemented as a rotatable intermediate transfer body for carrying a toner image transferred from the image carrier and transporting it to a stage where the toner image should be transferred to a sheet or similar transfer medium. The carrier shares the same technical concept with the other carriers of the kind transporting an object while electrostatically retaining it thereon. The embodiments to be described will concentrate on an intermediate transfer belt by way of example.

Figure 39:
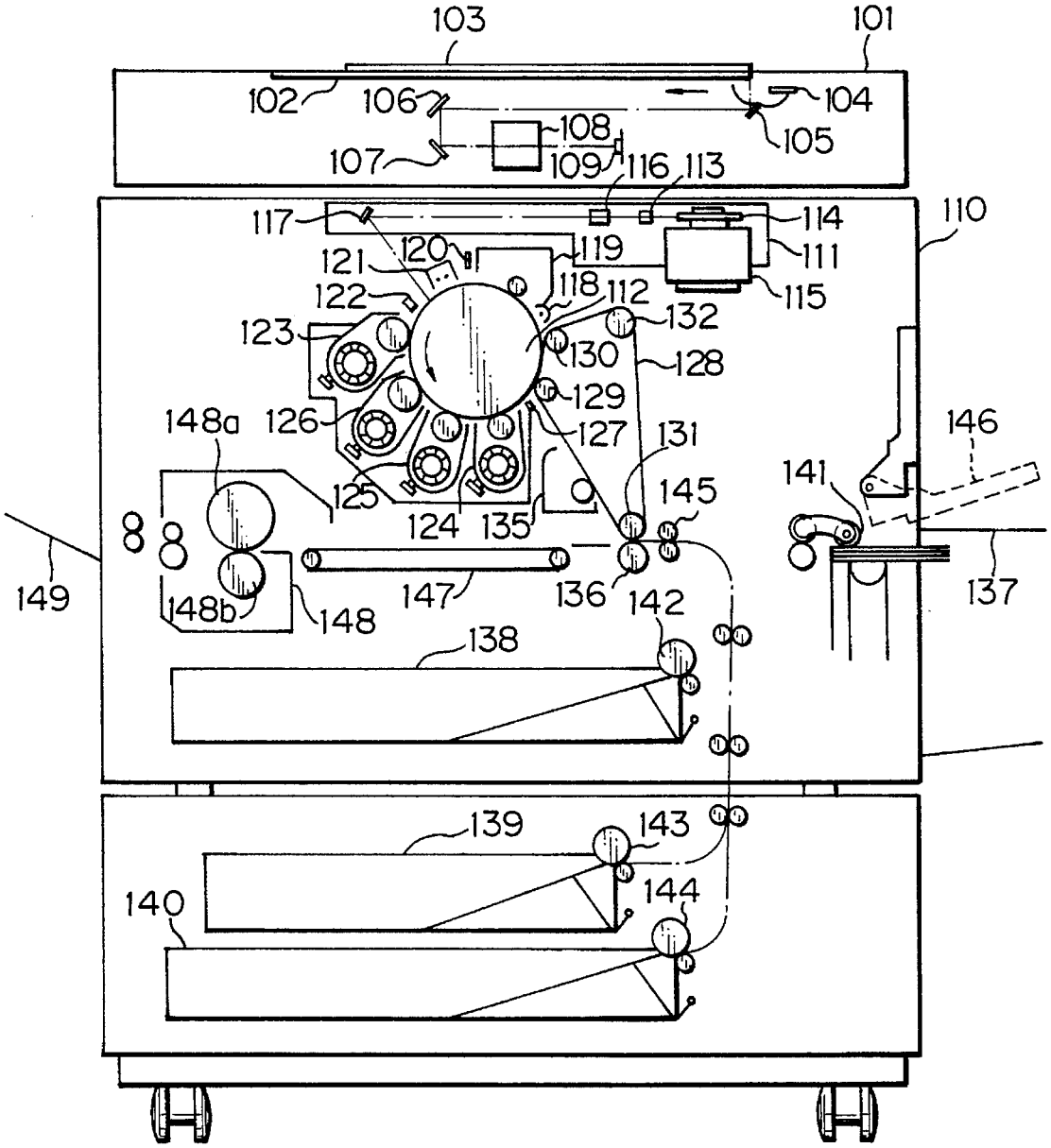
FIG. 39 is a section associated with FIG. 36.
Figure 40:
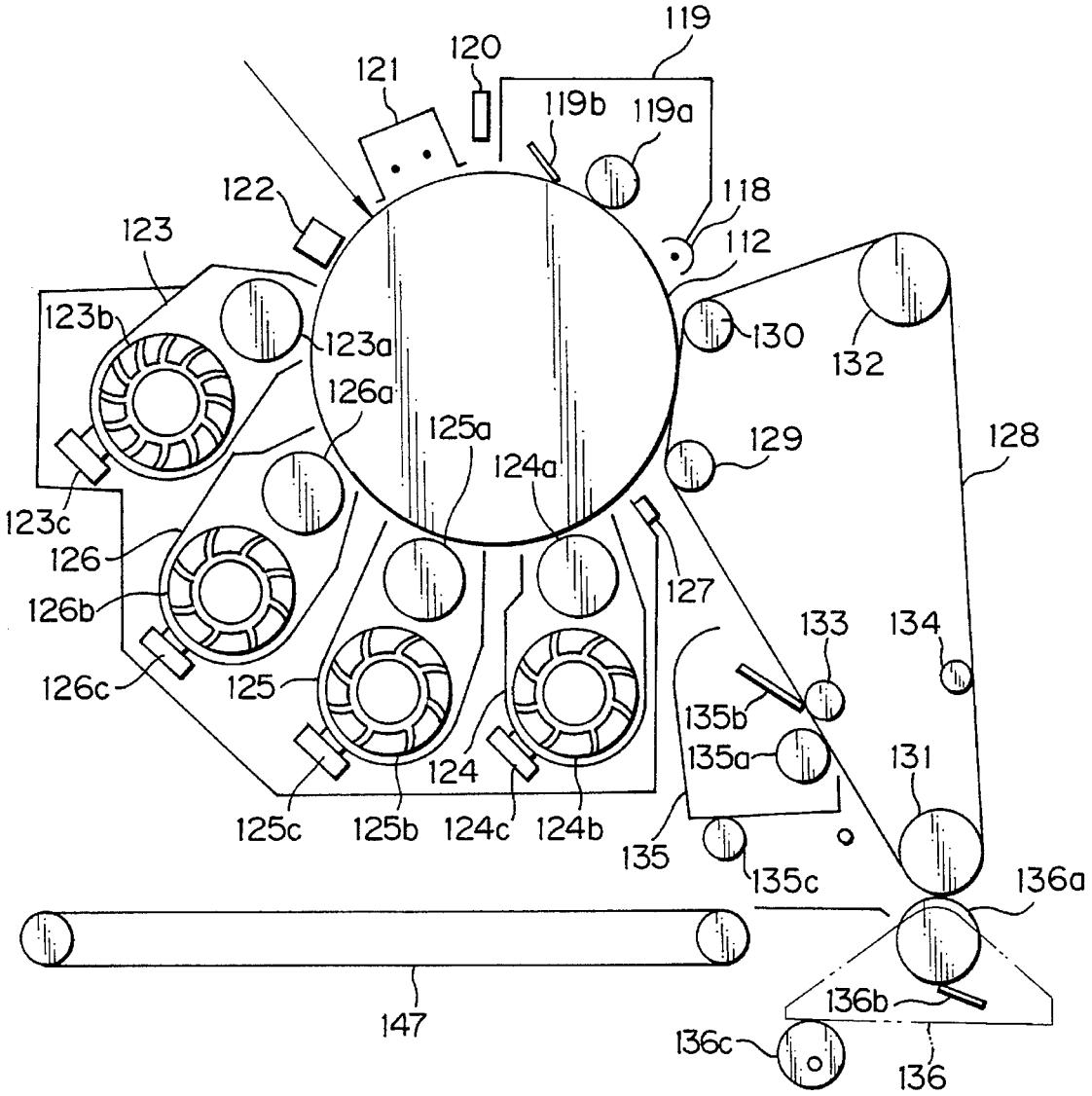
FIG. 40 is an enlarged view of a photoconductive drum, intermediate transfer belt and their associated members included in the embodiment of FIG. 39.

FIG. 39 shows an alternative embodiment of the present invention implemented as an electrophotographic copier. FIG. 40 is an enlarged view of a photoconductive drum and an intermediate transfer belt included in the embodiment as well as members surrounding them. As shown, the color copier has a color scanner 101 including a lamp 104. As the lamp 104 illuminates a document 103 laid on a glass platen 102, the resulting reflection from the document 103 is focused onto a color image sensor 109 via mirrors 105–107 and a lens 108. The color image sensor 109 reads the color image data by separating them into blue, green and red and converts them to corresponding electric signals. In the illustrative embodiment, the color image sensor 109 is made up of blue (B), green (G) and red (R) color separating means and a CCD array or similar photoelectric transducer so as to read the three different colors at the same time. B, G and R image signals from the image sensor 109 are converted to black (BK), cyan (C), magenta (M) and yellow (Y) color image data by an image processor, not shown, on the basis of their intensity levels.

A color image recorder, or color printer as referred to hereinafter, 110 forms BK, C, M and Y toner images on the basis of the color data from the image processor thereof, thereby producing a color copy. As a control section sends a scanner start signal synchronous to the operation of the color printer 110 to the scanner 101, the lamp 104 and optics 105– 107 included in the scanner 101 are moved to the left, as indicated by an arrow in FIG. 39. As the scanner 101 scans the document 103 once, image data of one color is produced. The scanner 101 repeats the scanning movement four consecutive times, producing BK, C, M and Y image data in succession. Every time the scanner 101 produces image data of one color, the color printer 102 forms a toner image of corresponding color. The toner images of four different colors are sequentially superposed to complete a full-color image.

The color printer 110 will be described specifically. An optical writing unit 111 converts the color image data from the image processor to an optical signal and then optically writes an image representative of the document image on a photoconductive drum 112 to thereby form an electrostatic latent image. The writing unit 111 includes a laser 113, a laser driver, not shown, for controlling the emission of the laser 113, a polygonal mirror 114, a motor 115 for driving the mirror 114, an f-theta lens 116, and a mirror 117. The drum 112 is rotatable counterclockwise, as indicated by an arrow. Arranged around the drum 112 are a cleaning unit (including a precleaning discharger 118) 119, a discharge lamp 120, a main charger 121, a potential sensor 122, a BK developing unit 123, a C developing unit 124, an M developing unit 125, a Y developing unit 126, a density pattern sensor 127, and an intermediate transfer belt 128. As shown in FIG. 40, the developing units 123–126 have respectively developing sleeves **123*a*, 124*a*, 125*a* and 126*a* rotatable in contact with the drum 112, paddles 123*b*, 124*b*, 125*b* and 126*b* rotatable for scooping and agitating associated developers, and toner concentration sensors 123*c*, 124*c*, 125*c* and 126*c* responsive to the toner concentrations of associated developers. In a standby state, all of the four developing units 123–126 maintain the developers on their sleeves 123*a*–126*a* in an inoperative position. Let the developing units 123–126** be assumed to develop latent images in this order, i.e., in BK, C, M and then Y by way of example.

At the beginning of a copying procedure, the drum 112 is rotated and has the surface thereof uniformly charged by the main charger 121. At a predetermined time, the color scanner 101 starts reading the document 103 to produce BK image data. As the BK image data is applied to the writing unit 111 via the image processor, the unit 111 scans the charged surface of the drum 112 by a laser beam to electrostatically form a latent image thereon. Let the latent image derived from the BK image data be referred to as a BK latent image. Likewise, let latent images resulting from C, M and Y image data be referred to as a C latent image, an M latent image, and a Y latent image, respectively. To develop the BK latent image from the leading edge thereof, the sleeve **123*a* starts rotating before the leading edge of the image reaches a developing position where the BK developing unit 123 faces the drum 112. As a result, the developer on the sleeve 123*a* is brought to an operative position to cause a BK toner contained therein to develop the BK latent image. As soon as the trailing edge of the BK latent image moves away from the BK developing position, the developer on the sleeve 123***a* is restored to the inoperative position. This is completed at least before the leading edge of the next latent image, i.e., the C latent image arrives at the BK developing position. To restore the developer to the inoperative position, the sleeve 123*a* is reversed. At this instant, the other developing units 124–126 are not operated.

The BK toner image formed on the drum 112 is transferred to the surface of the intermediate transfer belt 128 being moved at the same speed as the drum 112. The transfer of the toner image from the drum 112 to the intermediate transfer belt 128 will be referred to as belt transfer for simplicity. The belt transfer is effected by applying a predetermined bias voltage to bias rollers or bias electrodes 129 and 130 while the drum 112 and belt 128 are held in contact. After the transfer of the BK toner image, the cleaning unit 119 including the precleaning discharger 118 removes the charge and toner remaining on the drum 112. Then, the main charger 121 again uniformly charges the drum 112. The BK, C, M and Y toner images sequentially formed on the drum 112 are transferred one after another to the same surface of the belt 128 and in register with one another, completing a four-color belt transfer image. The belt transfer image is collectively transferred from the belt 128 to a sheet. The construction and operation of an intermediate transfer belt unit including the belt 128 will be described in detail later.

The step of forming the BK image is followed by a step of forming a C image. The color scanner 101 starts reading the document 103 at a predetermined time to generate C image data. The C image data is fed to the writing unit 111 by way of the image processor. In response, the writing unit 111 forms a C latent image on the drum 112 by a laser beam. After the trailing edge of the BK latent image has passed the developing position of the C developing unit 124 and before the leading edge of the C latent image reaches it, the developing unit 124 has the sleeve 124*a* thereof rotated to bring the developer to the operative position. As a result, the C latent image is developed by a C toner contained in the developer. When the trailing edge of the C latent image has moved away from the C developing unit 124, the developer on the sleeve 124*a* is brought to the inoperative position. Again, this is completed before the leading edge of an M latent image reaches the C developing unit 124. The C toner image formed on the drum 112 is transferred to the surface of the belt 128 being driven at the same speed as the drum 112.

After the formation of the C image, the color scanner 101 starts reading the document 103 at a predetermined time to generate M image data. As the M image data is fed to the writing unit 111 via the image processor, the writing unit 111 forms an M latent image on the drum 112 by a laser beam. After the trailing edge of the C latent image has passed the developing position of the M developing unit 125 and before the leading edge of the M latent image reaches it, the developing unit 125 has the sleeve 125*a* thereof rotated to bring the developer to the operative position. As a result, the M latent image is developed by an M toner contained in the developer. When the trailing edge of the M latent image has moved away from the M developing unit 125, the developer on the sleeve 125*a* is brought to the inoperative position. Again, this is completed before the leading edge of a Y latent image reaches the M developing unit 125. The M toner image formed on the drum 112 is transferred to the surface of the belt 128 being driven at the same speed as the drum 112. After the transfer of the M toner image, the drum 112 is discharged and cleaned by the cleaning unit 11 including the precleaning discharger 118 and again uniformly charged by the main charger 121.

The step of forming the M image is followed by a step of forming a Y image. The color scanner 101 starts reading the document 103 at a predetermined time to generate Y image data. As the Y image data is fed to the writing unit 111 via the image processor, the writing unit 111 forms a Y latent image on the drum 112 by a laser beam. After the trailing edge of the M latent image has passed the developing position of the Y developing unit 126 and before the leading edge of the Y latent image reaches it, the developing unit 126 has the sleeve 126*a* thereof rotated to bring the developer to the operative position. As a result, the Y latent image is developed by a Y toner contained in the developer. When the trailing edge of the Y latent image has moved away from the Y developing unit 126, the developer on the sleeve 126*a* is brought to the inoperative position. This is completed after the trailing edge of the Y image has reached the Y developing unit 126. The Y toner image formed on the drum 112 is transferred to the surface of the belt 128 being driven at the same speed as the drum 112.

As shown in FIG. 40, the intermediate transfer belt 128 is passed over a drive roller 131, bias rollers 129 and 130, and driven rollers 132–134. The drive roller 131 is driven by a motor, not shown, to move the belt 128. A belt cleaning unit 135 has a brush roller 135*a*, a rubber blade 135*b*, and a mechanism 135*c* for moving the unit 135 into and out of contact with the belt 128. After the transfer of the first image or BK image to the belt 128, the brush roller 135*a* and rubber blade 135*b* are spaced apart from the bias roller 129 by the mechanism 135*c* while the transfer of C, M and Y images to the belt 128 is under way. A sheet transfer unit 136 has a bias roller 136*a*, a roller cleaning blade 136*b*, and a mechanism 136*c* for moving the unit 136 into and out of contact with the belt 128. The bias roller 136*a* is usually spaced apart from the belt 128. At the time when the four-color composite image is to be transferred from the belt 128 to a sheet, the mechanism 136*c* urges the bias roller 136*a* against the belt 128. In this condition, a predetermined bias voltage is applied from a bias power source to the bias roller 136*a* to transfer the four-color image from the belt 128 to a sheet being transported through between the roller 136*a* and the belt 128. Specifically, as shown in FIG. 39, a sheet is fed from one of a plurality of cassettes 137–140 to a register roller 145 by associated one of pick-up rollers 141–144, or it is fed from a manual sheet feed tray 146 by a pick-up roller 141 to the register roller 145. The register roller 145 drives the sheet such that the leading edge thereof meets the leading edge of the four-color image carried on the belt 128.

Now, after the first or BK toner image has been entirely transferred to the belt 128, the belt 128 may be moved in any one of the following three modes or any combination thereof (matching the copy size).

CONSTANT SPEED FORWARD MODE (1) Even after the belt transfer of the BK toner image, the belt 128 is moved at a constant speed in the forward direction.

(2) The second or C toner image is formed on the drum 112 such that just when the leading edge of the BK image carried on the belt 128 reaches the belt transfer position where the belt 128 and drum 112 contact, the leading edge of the C toner image arrives at such a position. As a result, the C image is transferred to the belt 128 in accurate register with the BK image.

(3) The above procedure is repeated to sequentially form and transfer the M and Y images to complete a four-color image on the belt 128.

(b 4) After the belt transfer of the fourth or Y toner image, the belt 128 is continuously moved forward to collectively transfer the four-color image to a sheet.

SKIP FORWARD MODE (1) After the belt transfer of the BK toner image, the belt 128 is moved away from the drum 112, caused to skip at high speed in the forward direction over a predetermined distance, and then restored to the initial speed. Thereafter, the belt 128 is again brought into contact with the drum 112.

(2) The C toner image is formed on the drum 112 such that just when the leading edge of the BK image on the belt 128 again arrives at the belt transfer position, the leading edge of the C image reaches such a position. Consequently, the C image is transferred to the belt 128 in accurate register with the BK image.

(3) The above procedure is repeated to sequentially form and transfer the M and Y images to complete a four-color image on the belt 128.

(4) After the belt transfer of the fourth or Y toner image, the belt 128 is continuously moved forward to collectively transfer the four-color image to a sheet.

RECIPROCATION (OR QUICK RETURN) MODE (1) After the belt transfer of the BK toner image, the belt 128 is moved away from the drum 112 and then brought to a stop and, at the same time, returned at high speed in the reverse direction. The quick return of the belt 128 ends when the leading edge of the BK image on the belt 128 has moved a predetermined distance away from the belt transfer position.

(2) When the leading edge of the C toner image formed on the drum 12 reaches a position slightly short of the belt transfer position, the belt 128 is again driven forward and brought into contact with the drum 112. The C image is also accurately superposed on the BK image on the belt 128.

(3) The above procedure is repeated to sequentially form and transfer the M and Y images to complete a four-color image on the belt 128.

(4) After the belt transfer of the fourth or Y toner image, the belt 128 is continuously moved forward at the same speed without being returned, thereby collectively transferring the four-color image to a sheet.

As shown in FIG. 39, the sheet carrying the four-color toner image is transported to a fixing unit 148 by a sheet transport unit 147. In the fixing unit 148, a heat roller 148*a* controlled to a predetermined temperature and a pressure roller 148*b* cooperate to fix the toner image on the sheet by heat and pressure. Finally, the sheet with the fixed toner image is driven out to a copy tray 149 as a full-color copy. As shown in FIG. 40, after the belt transfer, the drum 112 is uniformly discharged by the precleaning discharger 118 and then cleaned by the brush roller 119*a* and rubber blade 119*b*. On the other hand, the belt 128 completed the image transfer is cleaned by the cleaning unit 136 which is pressed against the belt 128 by the mechanism 136*c*.

In a repeat copy mode for repetitively copying the document 103, the operation of the color scanner 101 and the image formation on the drum 112 begin after the fourth or Y image for the first copy has been formed. Then, a step of forming the first or BK image for the second copy begins at a predetermined time. After the four-color image has been transferred to the first sheet, the belt 128 has the surface thereof cleaned by the cleaning unit 135. The BK toner image for the second copy is transferred to the cleaned surface of the belt 128. Such a procedure is repeated thereafter.

The cassettes 137–140 are each loaded with sheets of particular size. As the operator selects one of the cassettes 137–140 on an operation panel, not shown, sheets are sequentially fed from the cassette selected to the register roller 145 by associated one of the pick-up rollers 141–144. The manual feed tray 146 may be used to insert OHP sheets or relatively thick sheets by hand.

The above description has concentrated on a four- or full-color copy. In a three-color or two-color copy mode, the procedure stated above will be performed with each of the colors selected on the operation panel a desired number of times. In a single color or monocolor copy mode, only one of the developing units matching the desired color will be held operative until a predetermined number of copies have been produced. In this case, the belt 128 will be moved forward at constant speed in contact with the drum 112, and the belt cleaning unit 135 will also be held in contact with the belt 128.

Figure 36:
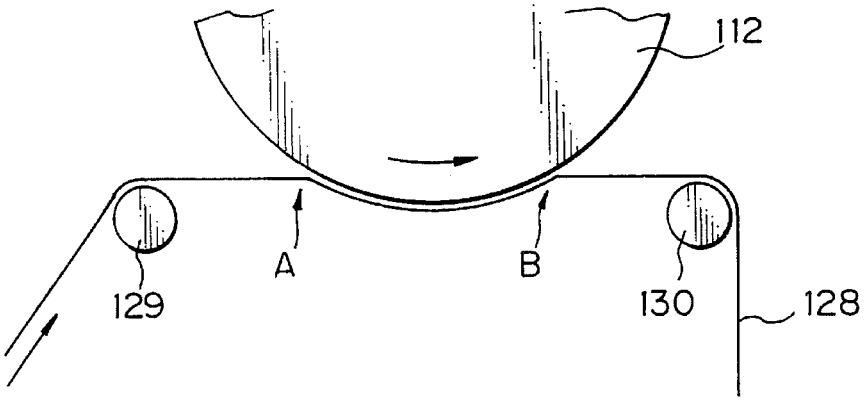
FIG. 36 is a side elevation showing another alternative embodiment of the present invention.
Figure 37:
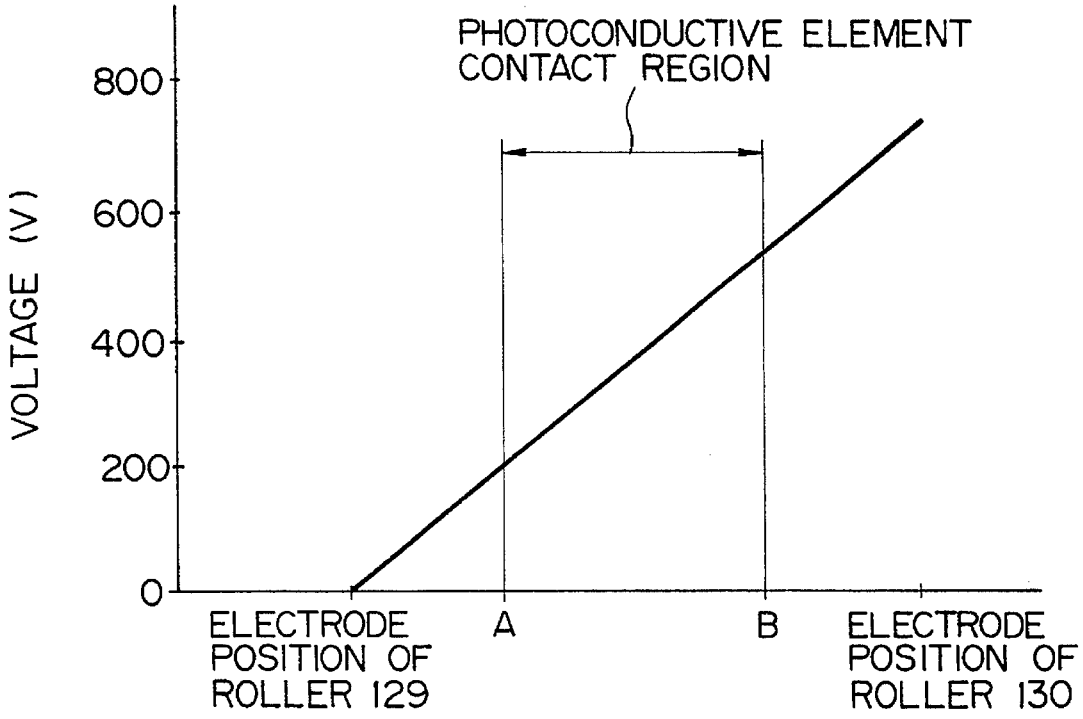
FIG. 37 shows a potential gradient of an intermediate transfer belt included in the embodiment of FIG. 36.
Figure 38:
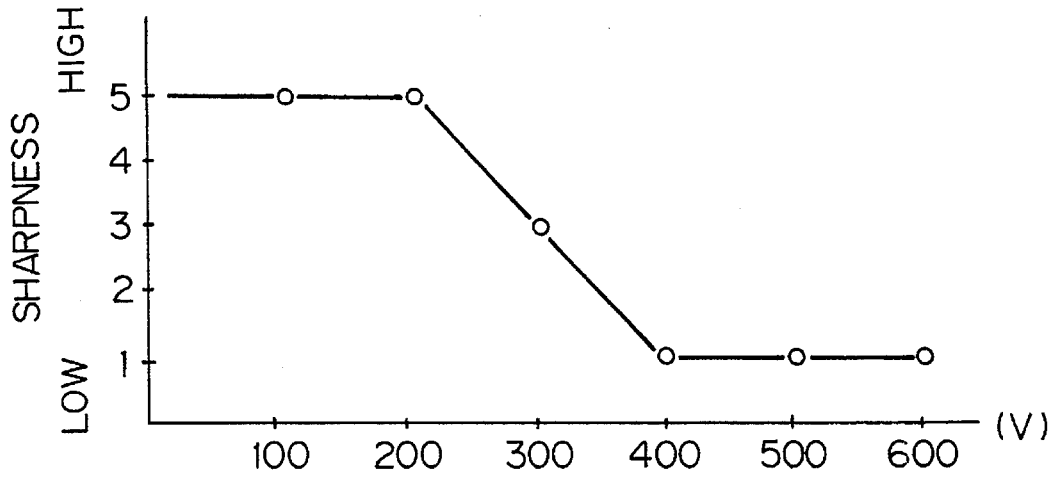
FIG. 38 is a graph showing a relation between the potential between a bias roller and a contact point particular to the embodiment of FIG. 36.

In this embodiment, as shown in FIG. 36, the belt 128 is held in contact with the drum 112 to transfer the toner image from the drum 112 to the belt 128. At this instant, the bias roller 129 is located upstream of a point A where the belt 128 and drum 112 contact, while the bias roller 130 is located downstream of a point B where the belt 128 and drum 112 contact. A transfer potential is applied to the bias roller 130 located at the outlet side (downstream) of the contact point B, while a potential lower than that transfer potential is applied to the bias roller 130 located at the inlet side (upstream) of the contact point A. For example, 700 V and 0 V are applied to the bias rollers 130 and 129, respectively. As a result, as shown in FIG. 37, a potential gradient is also set up in the region where the drum 112 and belt 128 contact. This eliminates discharge in the pretransfer region which would disturb image transfer and, at the same time, insures the separation of a sheet with no regard to the environment. FIG. 38 is a graph showing a relation between the potential between the bias roller 129 and the contact point A and the sharpness of an image. As shown, if the potential between the bias roller 129 and the contact point A is maintained lower than 300 V, there can be reduced pretransfer, i.e., the flight of toner occurring before the belt 128 and drum 112 contact in the event of image transfer. The resulting image is free from thickened lines, blurred characters, degraded sharpness, etc.

As FIG. 38 indicates, a desirable degree of sharpness is attainable if the potential between the bias roller 129 and the contact point A is lower than 300 V. The bias rollers 129 and 130 may each be provided with a desired reference potential which sets up the potential lower than 300 V between the bias roller 129 and the contact point A, if desired.

Figure 41:
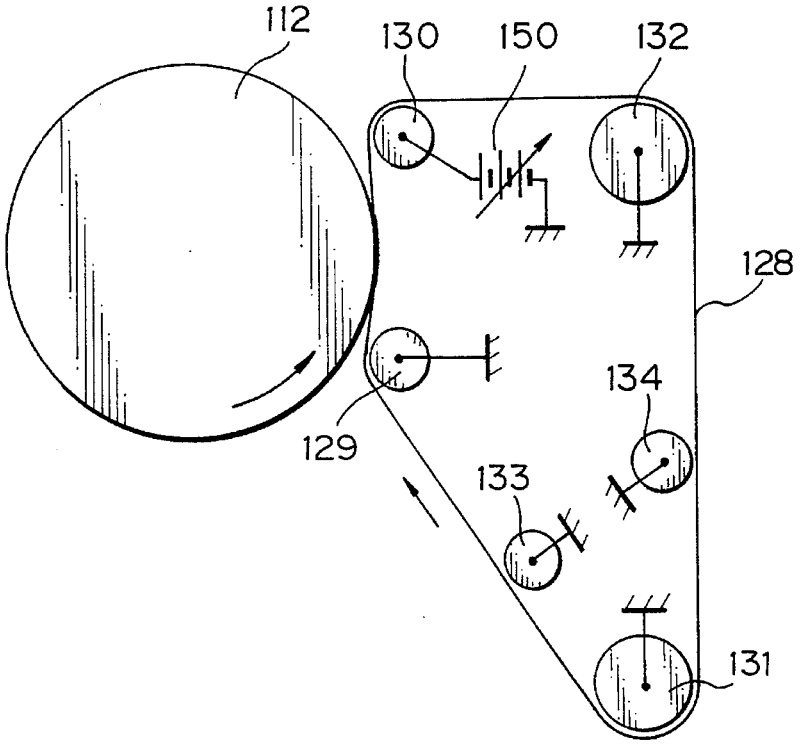
FIGS. 41–46 are side elevations each showing a further alternative embodiment of the present invention.

FIG. 41 shows a modification of the above embodiment in which the bias roller 129 and the other rollers 131–134 are connected to ground. In the modification, a transfer potential higher than the ground level is applied to the bias roller 130 from a variable transfer power source 150. This embodiment also reduces pretransfer and, in addition, simplifies the structure since the bias roller 129 is connected to ground.

Figure 42:
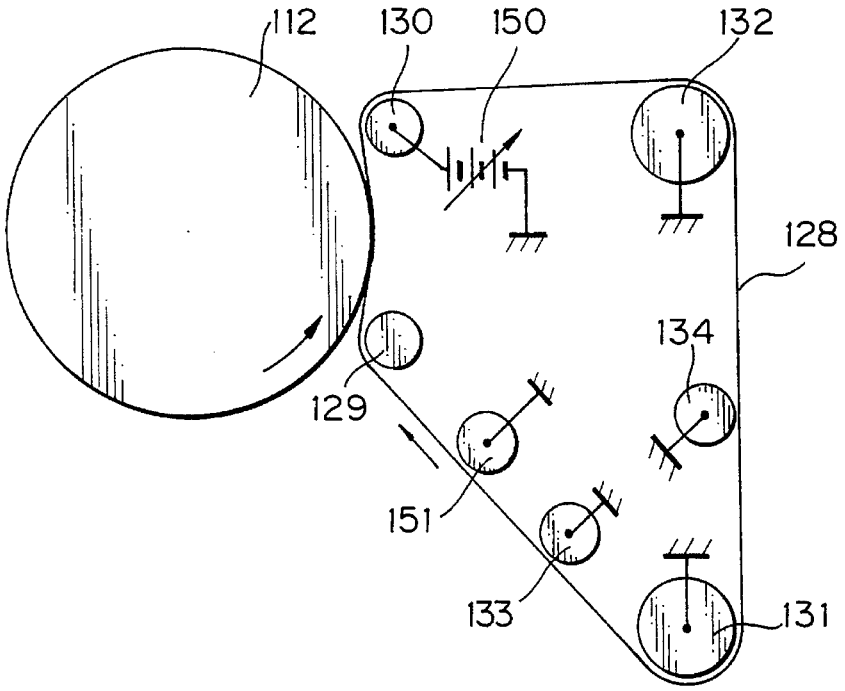

FIG. 42 shows another alternative embodiment which is similar to the embodiment of FIG. 41 except that the bias roller 129 is electrically floating, and that a roller 151 is held in contact with the belt 128 at a position upstream of the bias roller 129. The roller 151 is connected to ground. Although the bias roller 129 increases the potential at the contact point A when electrically floating as illustrated than when connected to ground, it is possible to lower the transfer voltage to be applied to the bias roller 130.

Figure 43:
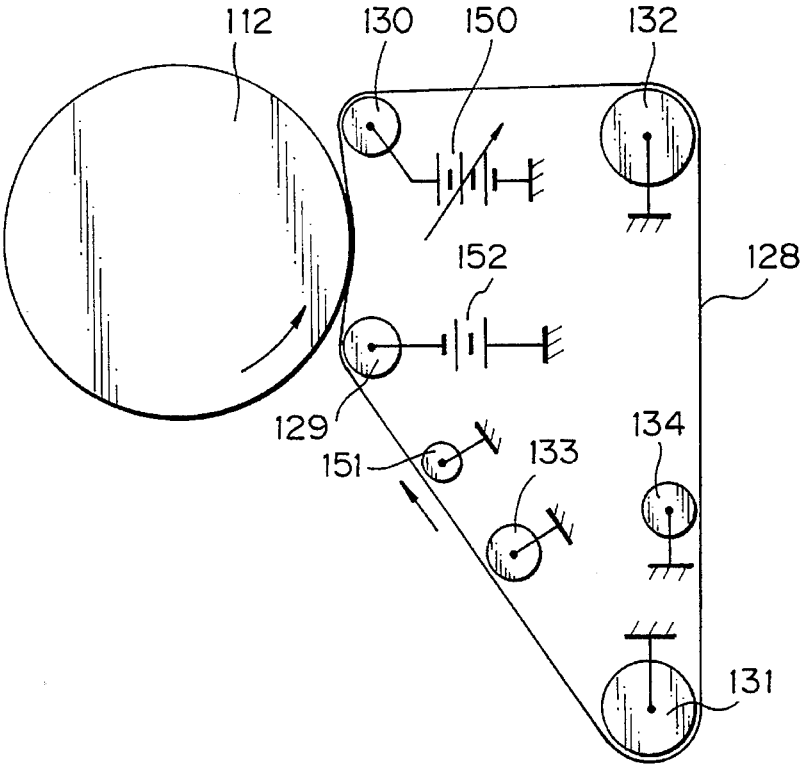

FIG. 43 shows another alternative embodiment which is similar to the embodiment of FIG. 42 except that a transfer power source 152 applies to the bias roller 129 a voltage lower than the voltage of the variable power source 150 and of the same polarity as the toner (negative in this case). The voltage applied from the power source 152 to the bias roller 129 generates an electric field of polarity opposite to the polarity of the toner on the drum 112. As a result, the toner on the drum 112 is prevented from flying from the belt 128 side, so that an attractive image is insured.

Figure 44:
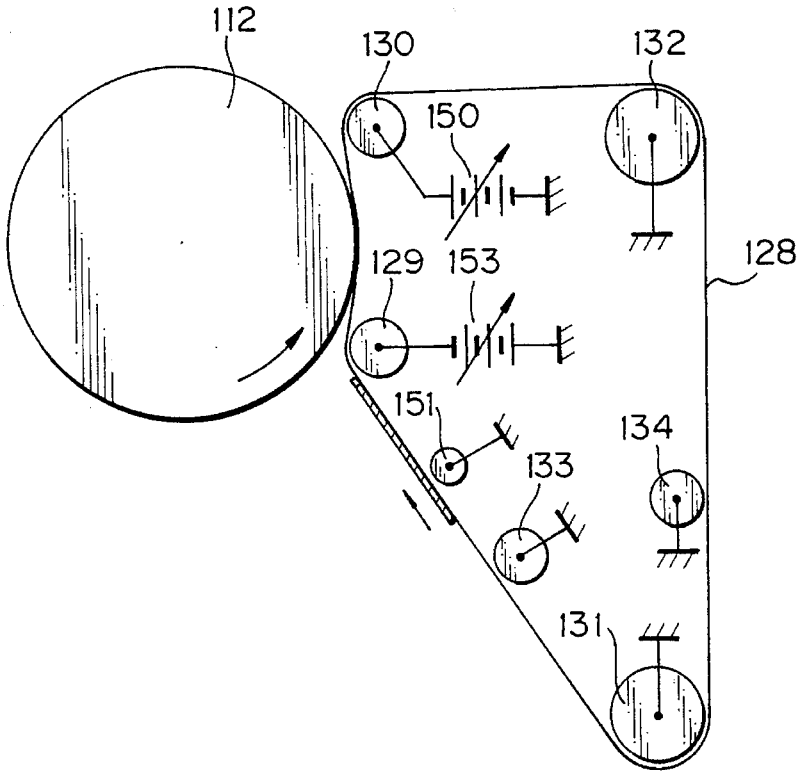

FIG. 44 shows another alternative embodiment which is similar to the embodiment of FIG. 43 except that the transfer power source 152 is replaced with a variable transfer power source 153. The variable power source 153 applies a voltage of the same polarity as the toner to the bias roller 129, as in the embodiment of FIG. 43. Such a voltage generates an electric field opposite in polarity to the toner on the drum 112. As a result, the toner on the drum 112 is prevented from flying from the belt 128 side, so that an attractive image is insured. Generally, as the belt 128 is repetitively used, a film of toner 154 is formed on the surface of the belt 128 (so-called toner filming). The film 154 is undesirable since it lowers the effective potential of the voltage. In such a case, the output voltage of the variable power source 15 will be increased to prevent the toner from flying.

Figure 45:
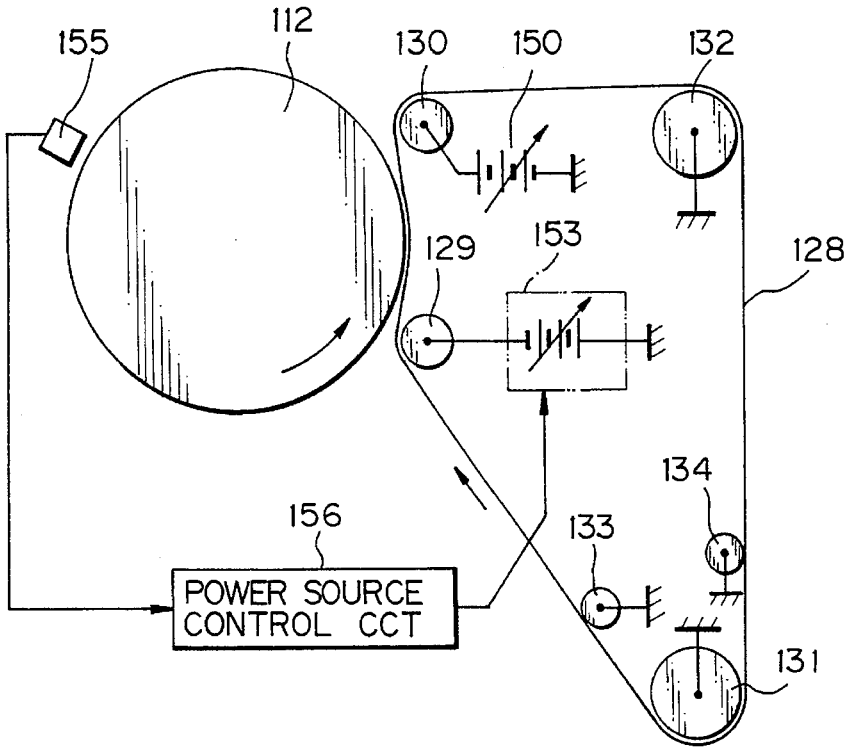

FIG. 45 shows still another alternative embodiment which is similar to the embodiment of FIG. 44 except that a potential sensor 155 and a power source control circuit 156 are provided, and that the roller 151 is omitted. The variable power source 153 applies a voltage of the same polarity as the toner to the bias roller 129, as in the embodiment of FIG. 43. This voltage generates an electric field opposite in polarity to the toner on the drum 112. As a result, the toner is prevented from flying from the belt 128 side, so that an attractive image is insured. Generally, as the drum 112 is repetitively used, the potential remaining thereon sequentially increases. The increase in the residual potential lowers the effective potential of the above-mentioned reverse electric field. Then, the output voltage of the variable power source 153 will be controlled on the basis of the output of the potential sensor 155 by the power source control circuit 156, depositing an adequate potential on the belt 128.

Figure 46:
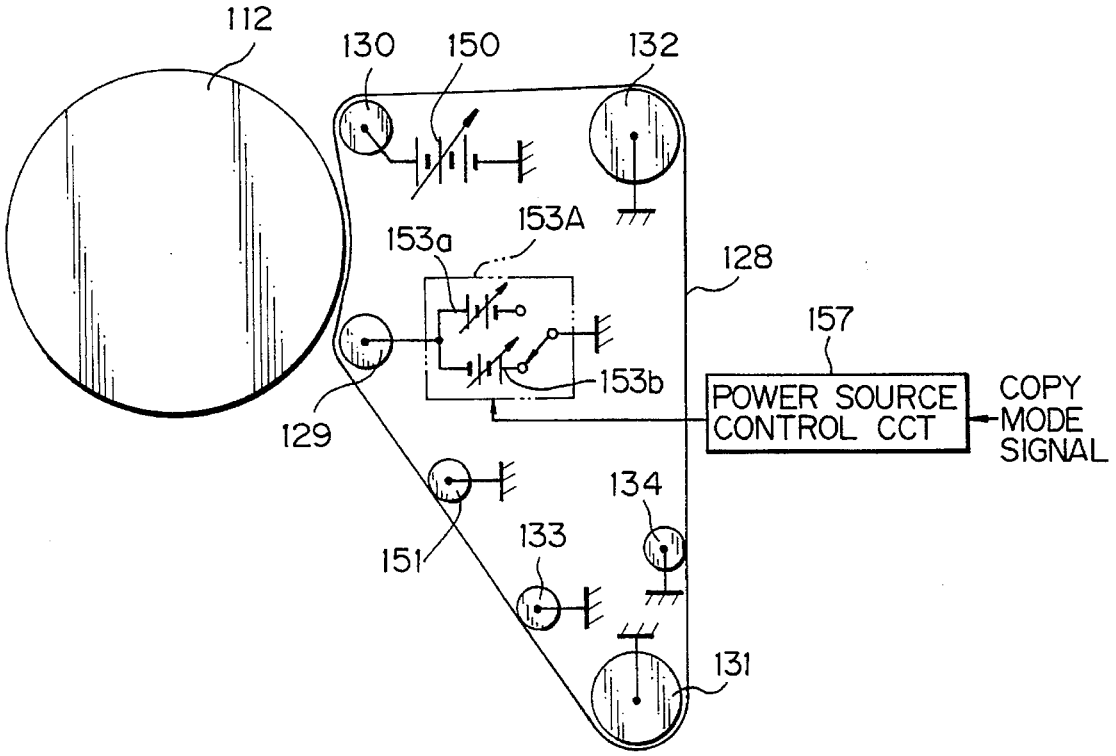

FIG. 46 shows a further alternative embodiment which is similar to the embodiment of FIG. 44 except that the variable transfer power source 153 is replaced with a variable positive/negative power source 153A, and that a power source control circuit 157 is provided. In the illustrative embodiment, to produce a two-color, three-color or four-color copy, the power source control circuit 157 switches the positive/negative power source 153A in response to a copy mode signal sent from a controller which controls the entire embodiment. Specifically, When the toner image of first color is to be transferred from the drum 112 to the belt 128, the control circuit 157 selects a variable transfer power source 153*b* and applies a negative voltage, i.e., a potential of the same polarity as the toner to the bias roller 129. In the step of transferring the toner image of second color from the drum 112 to the belt 128 and successive steps, when the potential opposite in polarity to the toner is used, the toner deposited on the belt 128 by the first transfer step will fly since the polarity thereof is negative. To eliminate this occurrence, the control circuit 157 selects the other variable transfer power source 153*a* and applies a positive voltage to the bias roller 129, i.e., switches the potential of the belt 128 to 0 V or positive potential.

In summary, it will be seen that the present invention provides an image forming apparatus having various unprecedented advantages, as enumerated below.

(1) An image can be desirably transferred without any degradation, and a transfer medium can be surely separated.

(2) The separation of the transfer medium is not effected by the environment.

(3) Desirable image transfer is achievable with no regard to irregularities in the resistance of a transfer belt.

(4) Although sheet transport control changes from one machine to another or within the same machine due to aging, an image can be surely transferred.

(5) There can be eliminated the damage to electrodes and transfer belt due to charge leakage and, therefore, defective image transfer ascribable to such damage.

Various modifications will become possible for those skilled in the art after receiving the teachings of the present disclosure without departing from the scope thereof.

What is claimed is:

1. An image forming apparatus comprising:

a photoconductive element for forming a toner image thereon;

a transfer medium movable in contact with said photoconductive element over a predetermined nip width to allow the toner image to be transferred from said photoconductive element to said transfer medium;

transfer bias applying means for applying a predetermined transfer bias to said transfer medium, said transfer bias applying means including an upstream bias applicator and a downstream bias applicator, said upstream and downstream applicators located respectively upstream and downstream from a nip location at which said photoconductive element contacts said transfer medium; and potential gradient generating means for providing the transfer bias applying means with a potential gradient; and means for varying an amount of bias provided by said potential gradient generating means and applied by at least one of said upstream and downstream bias applicators in response to changes in position of said transfer medium;

the apparatus further comprising sensing means for sensing a condition of said photoconductive element, and control means for varying a bias voltage to be applied to said upstream bias applicator in response to an output of said sensing means.

2. An apparatus as claimed in claim 1, wherein said upstream bias applicator is connected to ground via a constant voltage element.

3. An apparatus as claimed in claim 1, wherein said upstream bias applicator is electrically floating.

4. An apparatus as claimed in claim 1, wherein said upstream bias applicator is applied with a potential of the same polarity as the toner image, said downstream bias applicator being applied with a potential opposite in polarity to a toner.

5. An apparatus as claimed in claim 1, wherein said transfer medium comprises a sheet carried on and transported by a transfer belt which contacts said photoconductive element over a predetermined nip width.

6. The image forming apparatus of claim 1, wherein said means for varying an amount of bias increases a voltage applied to said upstream bias applicator when a leading edge of said transfer medium contacts said photoconductive element.

7. The image forming apparatus of claim 1, wherein said means for varying an amount of bias causes said potential gradient generating means to apply voltages to said upstream and downstream applicators after a portion of said transfer medium has moved a predetermined distance downstream from the nip.

8. An image forming apparatus comprising:

a photoconductive element for forming a toner image thereon;

a transfer medium movable in contact with said photoconductive element over a predetermined nip width to allow the toner image to be transferred from said photoconductive element to said transfer medium;

transfer bias applying means for applying a predetermined transfer bias to said transfer medium;

potential gradient generating means for providing the transfer bias applying means with a potential gradient;

wherein said transfer medium comprises a sheet carried on and transported by a transfer belt which contacts said photoconductive element over a predetermined nip width; and wherein the potential gradient generating means includes means for providing the transfer bias applying means with an additional bias potential after the sheet has contacted said photoconductive element;

the apparatus further including means for varying a time for applying the bias potential by said potential gradient generating means.

9. An apparatus as claimed in claim 8, further comprising:

humidity sensing means for sensing humidity; and control means responsive to an output of said humidity sensing means for adjusting the time for applying the bias potential by said potential gradient generating means when humidity is higher than a predetermined value.

10. An image forming apparatus comprising:

a photoconductive element for forming a toner image thereon;

a transfer medium movable in contact with said photoconductive element over a predetermined nip width to allow the toner image to be transferred from said photoconductive element to said transfer medium;

transfer bias applying means for applying a predetermined transfer bias to said transfer medium, said transfer bias applying means including an upstream bias applicator and a downstream bias applicator, said upstream and downstream applicators located respectively upstream and downstream from a nip location at which said photoconductive element contacts said transfer medium;

potential gradient generating means for providing the transfer bias applying means with a potential gradient; and means for varying an amount of bias provided by said potential gradient generating means and applied by at least one of said upstream and downstream bias applicators in response to changes in position of said transfer medium;

wherein said transfer medium comprises a sheet carried on and transported by a transfer belt which contacts said photoconductive element over a predetermined nip width at said nip location; and wherein said upstream bias applicator contacts said transfer belt at a position upstream of the nip location, and wherein said means for varying an amount of bias causes application of a bias lower than the transfer bias before the sheet contacts said photoconductive element and then application of a bias substantially equal to said transfer bias after said sheet has contacted said photoconductive element.

11. An apparatus as claimed in claim 10, further including means for varying a time for applying the bias potential by said potential gradient generating means.

12. An apparatus as claimed in claim 11, further comprising:

humidity sensing means for sensing humidity; and control means responsive to an output of said humidity sensing means for adjusting the time for applying the bias potential to said upstream bias applicator when humidity is higher than a predetermined value.

13. An image forming apparatus comprising:

a photoconductive element for forming a toner image thereon;

a transfer medium movable in contact with said photoconductive element over a predetermined nip width to allow the toner image to be transferred from said photoconductive element to said transfer medium;

transfer bias applying means for applying a predetermined transfer bias to said transfer medium, said transfer bias applying means including an upstream bias applicator and a downstream bias applicator, said upstream and downstream applicators located respectively upstream and downstream from a nip location at which said photoconductive element contacts said transfer medium;

potential gradient generating means for providing the transfer bias applying means with a potential gradient; and means for varying an amount of bias provided by said potential gradient generating means and applied by at least one of said upstream and downstream bias applicators in response to changes in position of said transfer medium;

wherein said transfer medium comprises a sheet carried on and transported by a transfer belt which contacts said photoconductive element over a predetermined nip width at said nip location; and said downstream bias applicator and said nip location being separated by a distance shorter than a distance between said upstream bias applicator and said nip location;

wherein said means for varying an amount of bias causes said upstream bias applicator to be applied with a bias after the sheet has been transported by said transfer belt over a distance exceeding the distance between said upstream bias applicator and said nip location;

the apparatus further including means for varying a time for applying the bias potential to said upstream bias applicator.

14. An apparatus as claimed in claim 13, further comprising:

humidity sensing means for sensing humidity; and control means responsive to an output of said humidity sensing means for adjusting the time for applying the bias potential to said upstream bias applicator when humidity is higher than a predetermined value.

15. An image forming apparatus comprising:

a photoconductive element for forming a toner image thereon;

a transfer belt in contact with said photoconductive element at a nip portion, said transfer belt transporting a sheet to allow the toner image to be transferred from said photoconductive element to said sheet;

transfer potential bias applying means for applying a predetermined transfer bias to said transfer belt;

potential gradient generating means for providing the transfer bias applying means with a first potential gradient having a magnitude greater than zero; and wherein said potential gradient generating means further includes means for providing the transfer potential bias applying means with an additional bias to thereby provide the transfer potential bias applying means with a second potential gradient after at least a portion of the sheet has entered the nip portion, and wherein a bias potential of at least a portion of said transfer belt has a larger magnitude when the second potential gradient is provided to said transfer bias applying means as compared with the first potential gradient.

16. An apparatus as claimed in claim 15, further including means for varying a time for applying the bias potential by said potential gradient generating means.

17. An apparatus as claimed in claim 16, further comprising:

humidity sensing means for sensing humidity; and control means responsive to an output of said humidity sensing means for adjusting the time for applying the bias potential by said potential gradient generating means when humidity is higher than a predetermined value.

18. The image forming apparatus of claim 15, wherein said transfer potential bias applying means includes a downstream bias applicator located downstream from said nip portion, said transfer potential bias applying means further including an upstream bias applicator located upstream of said nip portion, and wherein a magnitude of a voltage applied to said upstream bias applicator is larger for said second potential gradient than for said first potential gradient.

19. An image forming apparatus comprising:

a photoconductive element for forming a toner image thereon;

a transfer belt in contact with said photoconductive element over a predetermined nip width at a nip location for transporting a sheet to allow the toner image to be transferred from said photoconductive element to said sheet;

a downstream bias applicator contacting said transfer belt at a position downstream of said nip location for applying a predetermined bias to said transfer belt; and an upstream bias applicator having a dielectric layer on a surface thereof and contacting said transfer belt at a position upstream of said nip location, and wherein a common power source applies a voltage to each of said upstream and downstream bias applicators, and wherein said dielectric layer causes said upstream bias applicator to deposit a charge on said transfer belt less efficiently than said downstream bias applicator.

20. An image forming apparatus comprising:

a photoconductive element for forming a toner image thereon;

a transfer belt in contact with said photoconductive element over a predetermined nip width at a nip location for transporting a sheet to allow the toner image to be transferred from said photoconductive element to said sheet;

a downstream bias applicator contacting said transfer belt at a position downstream of said nip location for applying a predetermined bias to said transfer belt; and an upstream bias applicator having an elastic dielectric layer on a surface thereof and contacting a rear of said transfer belt at a position upstream of said nip location, and wherein a common power source applies a voltage to each of said upstream and downstream bias applicators, and wherein said dielectric layer causes said upstream bias applicator to deposit a charge on said transfer belt less efficiently than said downstream bias applicator.

21. An image forming apparatus comprising:

a photoconductive element for forming a toner image thereon;

a transfer medium contacting said photoconductive element over a predetermined nip width in a transfer region and undergoing a step of transferring the toner image formed on said photoconductive element a plurality of times;

a first electrode contacting said transfer medium at a position downstream of the transfer region;

a second electrode contacting said transfer medium at a position upstream of the transfer region; and potential gradient generating means for providing a transfer bias with a potential gradient by applying a transfer bias to said first electrode, and applying, when a toner is absent on said transfer medium, a bias of the same polarity as the toner to said second electrode, and further applying, when the toner is present on said transfer medium, a bias of opposite polarity to the toner to said second electrode.

22. An apparatus as claimed in claim 21, wherein said transfer medium comprises an intermediate transfer belt for directly carrying the toner thereon and carrying a toner of one of a plurality of respective colors in each of a plurality of consecutive transfer steps.

23. An image forming apparatus comprising:

a photoconductive element for forming a toner image thereon;

a transfer belt in contact with said photoconductive element over a predetermined nip width at a nip location for transporting a sheet to allow the toner image to be transferred from said photoconductive element to said sheet;

a downstream bias applicator contacting said transfer belt at a position downstream of said nip location for applying a predetermined bias to said transfer belt; and an upstream bias applicator having a dielectric layer on a surface thereof and contacting said transfer belt at a position upstream of said downstream bias applicator, wherein a common power source applies a voltage to each of said upstream and downstream bias applicators, and wherein said dielectric layer causes said upstream bias applicator to deposit a charge on said transfer belt less efficiently than said downstream bias applicator.

24. An image forming apparatus comprising:

a photoconductive element for forming a toner image thereon;

a transfer belt which contacts said photoconductive element;

first and second bias applicators which contact said transfer belt at separate locations; and means for applying voltages to each of said first and second bias applicators, said means for applying voltages applying a first voltage to said first bias applicator and a second voltage to said second bias applicator, wherein said second voltage has a same polarity as said first voltage but a smaller magnitude than said first voltage.

25. The image forming apparatus of claim 24, wherein said first bias applicator is located downstream from a position at which said transfer belt contacts said photoconductive element and said second bias applicator is located upstream of said position.

26. The image forming apparatus of claim 24, wherein said toner image is transferred to a transfer medium passing through a nip formed by said transfer belt and said photoconductive element, and wherein said means for applying voltages includes means for varying the voltage applied to at least said second bias applicator in response to changes in position of said transfer medium.

27. The image forming apparatus of claim 26, wherein said means for varying the voltage increases the magnitude of said second voltage.

28. The image forming apparatus of claim 27, wherein said means for varying the voltage increases the second voltage when a leading edge of said transfer medium enters said nip.

29. The image forming apparatus of claim 27, wherein said second voltage is increased to be equal to said first voltage.

30. The image forming apparatus of claim 28, wherein said second voltage is increased to be equal to said first voltage.

31. The image forming apparatus of claim 26, wherein said first bias applicator is located downstream from a position at which said transfer belt contacts said photoconductive element, and said second bias applicator is located upstream of said position.

32. An image forming apparatus comprising:

a photoconductive element for forming a toner image thereon;

a transfer medium movable in contact with said photoconductive element over a predetermined nip width to allow the toner image to be transferred from said photoconductive element to said transfer medium;

transfer bias applying means for applying a predetermined transfer bias to at least one of said transfer medium and a transfer belt carrying said transfer medium, said transfer bias applying means including an upstream bias applicator and a downstream bias applicator, said upstream and downstream applicators located respectively upstream and downstream from a nip location at which said photoconductive element contacts said transfer medium; and potential gradient generating means for providing the transfer bias applying means with a potential gradient; and the apparatus further comprising means for varying an amount of bias applied by said upstream bias applicator in response to changes in position of said transfer medium, such that a first voltage is applied to said upstream bias applicator before said transfer medium contacts said photoconductive element, and wherein a voltage applied to said upstream bias applicator is increased to a second voltage after said transfer medium contacts photoconductive element, and wherein a magnitude of said second voltage is greater than a magnitude of said first voltage, and further wherein a magnitude of said first voltage is greater than zero.

* * * * *